US007724223B2

(12) United States Patent
Kurosawa et al.

(10) Patent No.: US 7,724,223 B2
(45) Date of Patent: May 25, 2010

(54) LIQUID CRYSTAL DISPLAY APPARATUS

(75) Inventors: Teppei Kurosawa, Utsunomiya (JP); Jun Koide, Tokyo (JP); Masayuki Abe, Utsunomiya (JP); Yuya Kurata, Utsunomiya (JP)

(73) Assignee: Canon Kabushiki Kaisha (JP)

( * ) Notice: Subject to any disclaimer, the term of this patent is extended or adjusted under 35 U.S.C. 154(b) by 781 days.

(21) Appl. No.: 11/616,597

(22) Filed: Dec. 27, 2006

(65) Prior Publication Data

US 2007/0176877 A1 Aug. 2, 2007

(30) Foreign Application Priority Data

Jan. 6, 2006 (JP) ..... 2006-001898
Dec. 18, 2006 (JP) ..... 2006-339570

(51) Int. Cl.
*G09G 3/36* (2006.01)

(52) U.S. Cl. ..... 345/87; 345/96; 345/98

(58) Field of Classification Search ..... 345/87, 345/96, 98

See application file for complete search history.

(56) References Cited

U.S. PATENT DOCUMENTS

| | | | | |
|---|---|---|---|---|
| 6,429,840 | B1 * | 8/2002 | Sekiguchi | 345/88 |
| 7,038,748 | B2 | 5/2006 | Sasaki | |
| 2002/0089477 | A1 * | 7/2002 | Kanbe et al. | 345/87 |
| 2002/0140653 | A1 * | 10/2002 | Koyama | 345/87 |
| 2003/0189543 | A1 * | 10/2003 | Nakayoshi et al. | 345/98 |
| 2003/0231155 | A1 * | 12/2003 | Ogawa | 345/89 |
| 2005/0238853 | A1 * | 10/2005 | Kim et al. | 428/192 |

FOREIGN PATENT DOCUMENTS

| | | |
|---|---|---|
| EP | 1 372 135 A2 | 12/2003 |
| JP | H06-250148 | 9/1994 |
| JP | 2002-365654 | 12/2002 |
| JP | 2005-049817 | 2/2005 |
| WO | 02/44795 A2 | 6/2002 |
| WO | 02/44795 A3 | 6/2002 |

OTHER PUBLICATIONS

Extended European Search Report issued in corresponding European Patent Application No. 06127310.8 dated Jul. 23, 2009.
Chinese Office Action dated Aug. 1, 2008 concerning appln No. 200710001829.3 and English translation.

* cited by examiner

*Primary Examiner*—Bipin Shalwala
*Assistant Examiner*—Benyam Ketema
(74) *Attorney, Agent, or Firm*—Rossi, Kimms & McDowell LLP

(57) ABSTRACT

A liquid crystal display apparatus is disclosed which can prevent occurrence of flicker for a long time. The apparatus comprises a liquid crystal modulation element which includes a first electrode, a second electrode made of a material different from that of the first electrode, a liquid crystal layer disposed between the first and second electrodes, a first alignment film disposed between the first electrode and the liquid crystal layer, and a second alignment film disposed between the second electrode and the liquid crystal layer. The apparatus also comprises a controller which changes at least one of the potential to be applied to the first electrode and the central potential of the potential to be applied to the second electrode, which periodically changes between positive and negative with respect to the central potential, such that flicker is suppressed within a certain range.

6 Claims, 12 Drawing Sheets

PRIOR ART

LIQUID CRYSTAL DISPLAY APPARATUS

BACKGROUND OF THE INVENTION

The present invention relates to a liquid crystal display apparatus using a liquid crystal modulation element, such as a liquid crystal projector.

Some of the liquid crystal modulation elements are realized by putting nematic liquid crystal having positive dielectric anisotropy between a first transparent substrate having a transparent electrode (common electrode) formed thereon and a second transparent substrate having a transparent electrode (pixel electrode) forming pixels, wiring, switching elements and the like formed thereon. The liquid crystal modulation element is referred to as a Twisted Nematic (TN) liquid crystal modulation element in which the major axes of liquid crystal molecules are twisted by 90 degrees continuously between the two glass substrates. This liquid crystal modulation element is used as a transmissive liquid crystal modulation element.

Some of the liquid crystal modulation elements utilize a circuit substrate having reflecting mirrors, wiring, switching elements and the like formed thereon instead of the abovementioned second transparent substrate. This is called a Vertical Arrangement Nematic (VAN) liquid crystal modulation element in which the major axes of liquid crystal molecules are alignment in homeotropic alignment substantially perpendicularly to two substrates. The liquid crystal modulation element is used as a reflective liquid crystal modulation element.

In these liquid crystal modulation elements, typically, Electrically Controlled Birefringence (ECB) effect is used to provide retardation for a light wave passing through a liquid crystal layer to control the change of polarization of the light wave, thereby forming an image from the light.

In the liquid crystal modulation element, which utilizes the ECB effect to modulate the light intensity, application of an electric field to the liquid crystal layer moves ionic materials present in the liquid crystal layer. When a DC electric field is continuously applied to the liquid crystal layer, the ionic materials are pulled toward one of two opposite electrodes. Even when a constant voltage is applied to the electrodes, part of the electric field applied to the liquid crystal layer is cancelled out by the charged ions to substantially attenuate the electric field applied to the liquid crystal layer.

To avoid such a phenomenon, a line inversion drive method is typically employed in which the polarity of an applied electric field is reversed between positive and negative for each line of arranged pixels and is changed in a predetermined cycle such as 60 Hz or the like. In addition, a field inversion drive method is used in which the polarity of an applied electric field to all of arranged pixels is reversed between positive and negative in a predetermined cycle. Those drive methods can avoid the application of the electric field of only one polarity to the liquid crystal layer to prevent the unbalanced ions.

This corresponds to controlling the effective electric field to be applied to the liquid crystal layer such that it always has the same value as the voltage to be applied to the electrodes.

The variations of the effective electric field applied to the liquid crystal layer, however, are caused not only by the abovementioned movement of the ionic materials but also by other factors. One of the other factors causes trapping of charges of electrons or holes in a non-conductive film such as a liquid crystal alignment film made of an insulating material, a reflection enhancing film, and an inorganic passivation film for preventing dissolution of metal. The trapping causes charge-up on the interface of the film, and that electrostatic charge changes the effective electric field applied to the liquid crystal layer with time.

The charging phenomenon may be seen due to the shape in the transmissive liquid crystal modulation element and occurs prominently in the reflective liquid crystal modulation element including opposite electrodes formed of different materials (mirror metal and indium tin oxide (ITO) film).

To avoid the charging phenomenon, the following technique has been disclosed in Japanese Patent Laid-Open No. 2005-49817. In the method disclosed therein, a work-function adjusting film layer is formed on a reflecting pixel electrode to control the work function of the reflecting electrode to be ±2% or less relative to the work function of a transparent electrode (ITO film electrode) opposite thereto, thereby reducing charge-up on an interface layer of the liquid crystal to avoid occurrence of flicker or image sticking on the liquid crystal modulation element (or the liquid crystal display apparatus with the same).

In addition, trapping of charges requires excitation hopping of the energy potential of the insulating film. In Japanese Patent Laid-Open No. 2005-49817, the probabilities of the excitation hopping from the metallic mirror electrode and the ITO transparent electrode are made substantially equal to each other, thereby generating charge-up due to charge trapping of the same amount on both electrode sides.

This results in a shift in potential of the electric field applied to the liquid crystal layer in the field inversion drive method whereas a change in magnitude of the electric field does not occur. Since the electric field generated in the liquid crystal depends on the relative value between the opposite electrodes, the operation of the liquid crystal does not change.

However, only providing a film for adjusting the difference of the work functions between the opposite electrodes to the liquid crystal modulation element is not sufficient to ensure reliability thereof in a long term. The charges charged up in the liquid crystal layer are gradually accumulated with operating time of the liquid crystal modulation element, and thereby the potential difference between the mirror electrode and the ITO electrode reaches a few hundred millivolts in operating time from a few thousand hours to a few tens of thousand hours. This phenomenon occurs more often as the photon energy entering the liquid crystal modulation element and total amount of light energy increase.

The potential difference between the mirror electrode and the ITO electrode causes the difference of retardation modulation of liquid crystal depending on the polarity of the electric field applied on the liquid crystal layer, and thereby the light modulation intensity oscillates at 60 Hz in the case of driving at 60 Hz by the field inversion drive method. The oscillation of the light intensity at 60 Hz cannot be sensed by human eyes.

When the amplitude of the oscillation increases such that the potential difference between the opposite electrodes exceeds more than 200 mV, a low frequency component of the oscillation increases, thereby causing a large oscillation of the light intensity which is visible to a human eye as flicker. The visibility thereof is high particularly when a 50 percent intensity modulation is performed in which a gradation gamma changes drastically.

Furthermore, the potential difference between the mirror electrode and the ITO transparent electrode due to the charge-up on the liquid crystal interface layer causes an additional problem. Specifically, the constant DC electric field is continuously applied to the liquid crystal layer, so that ionic materials present in a small amount in the liquid crystal layer is pulled toward one of the opposite electrodes. The ionic material may be pulled toward the interfaces on both sides of the liquid crystal layer depending on the polarity of the charge of the ion.

Since the ions attached to the interface of the electrode are moved in accordance with the amplitude of a drive potential in the field inversion drive, the attachment state of the ions varies with the level of the amplitude of the drive potential. This results in variations of the effective electric field applied to the liquid crystal layer at different positions in a display area, which causes sticking. When the same image is displayed for a long time and then a different image is displayed, the previous image is seen as an afterimage. This is called the image sticking (or simply, sticking).

BRIEF SUMMARY OF THE INVENTION

The present invention provides a liquid crystal display apparatus which can prevent occurrence of flicker and sticking for a long time.

The present invention in its one aspect provides a liquid crystal display apparatus, which comprises a liquid crystal modulation element which includes a first electrode, a second electrode made of a material different from that of the first electrode, a liquid crystal layer disposed between the first and second electrodes, a first alignment film disposed between the first electrode and the liquid crystal layer, and a second alignment film disposed between the second electrode and the liquid crystal layer. The liquid crystal display apparatus displays images with light entering the liquid crystal layer from the first electrode side. The apparatus also comprises a controller which controls potentials to be applied to the first and second electrodes such that the potential difference to be applied to the liquid crystal layer is periodically changed between positive and negative, the potential to be applied to the second electrode periodically changing between positive and negative with respect to a central potential. The controller changes at least one of the potential to be applied to the first electrode and the central potential of the potential to be applied to the second electrode such that flicker is suppressed within a certain range.

Other objects and features of the present invention will become readily apparent from the following description of the preferred embodiments with reference to accompanying drawings.

DETAILED DESCRIPTION OF THE PREFERRED EMBODIMENTS

Preferred embodiments of the present invention will hereinafter be described with reference to the drawings.

Figure 1:
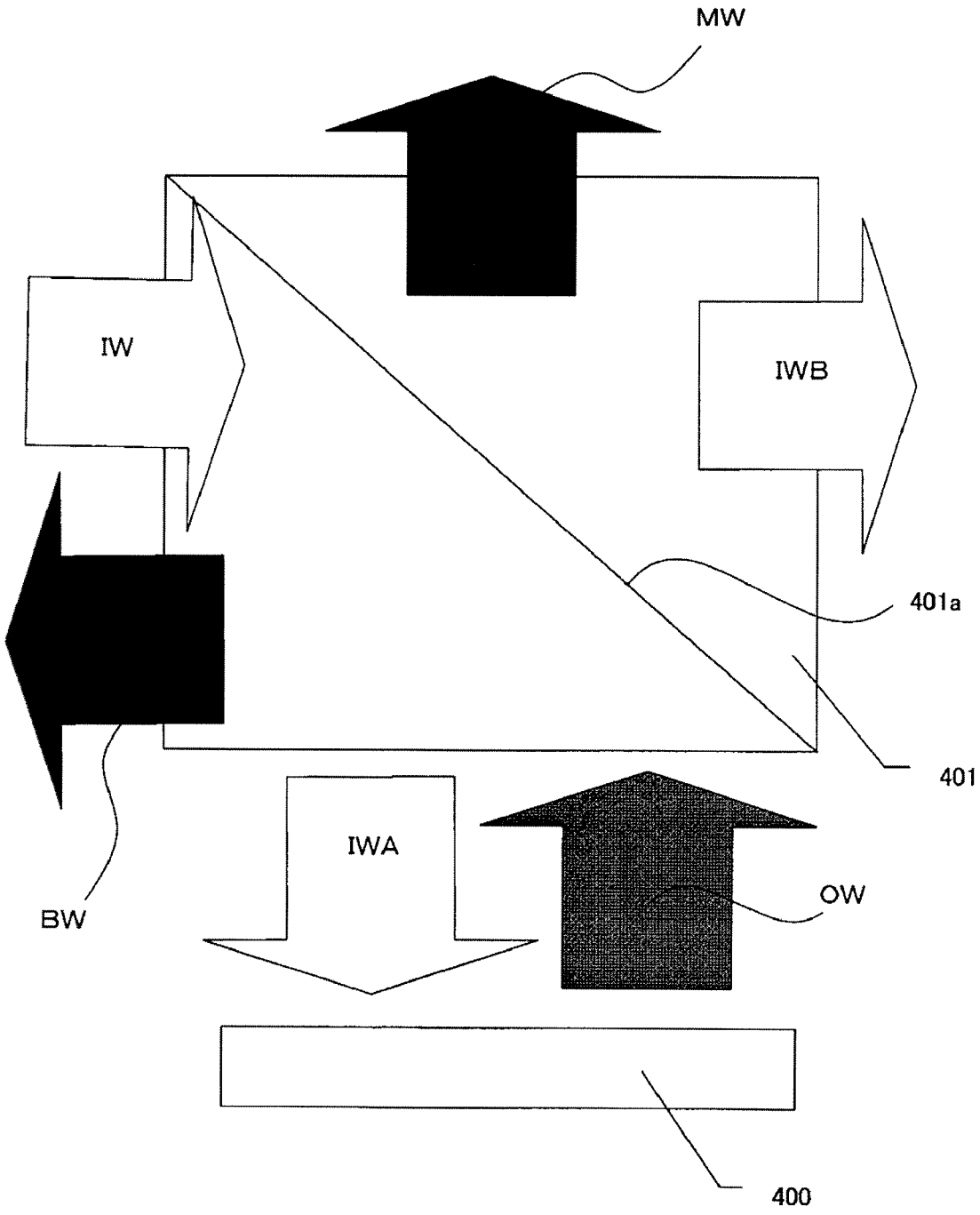
FIG. 1 is a schematic view showing the operation of a reflective liquid crystal modulation element and a beam splitter.

FIG. 1 shows optical paths in a liquid crystal display apparatus. As shown in FIG. 1, light from a light source indicated by the arrow IW enters the polarization beam splitter 401. Of the light entering the polarization beam splitter 401, a P-polarized light component is transmitted through a polarization beam splitting surface (polarization beam splitting film) 401*a* in the direction of the arrow IWB, while an S-polarized light component is reflected by the polarization beam splitting surface 401*a*in the direction of the arrow IWA. The S-polarized light component is linearly polarized light with a polarization direction perpendicular to the sheet of FIG. 1.

The pretilt angle of liquid crystal in the reflective liquid crystal modulation element 400 is inclined by 45 degrees with respect to the polarization direction of the S-polarized light component. An electric field is applied to a liquid crystal layer of the reflective liquid crystal modulation element 400 such that the liquid crystal layer provides a retardation of one-half wavelength for the entering light. The light entering the reflective liquid crystal modulation element 400 is propagated through the liquid crystal layer in two specific modes. When the light is reflected and emerges from the reflective liquid crystal modulation element 400 in the direction of the arrow OW, the light has a phase difference $\delta(\lambda)$ represented by the following expression (1) between the two specific modes:

$$\delta(\lambda)=2\pi(2d\Delta n)/\lambda \quad (1)$$

where $\lambda$ represents the wavelength of the entering light, d the thickness of the liquid crystal layer, and $\Delta n$ the anisotropy of refractive index of the liquid crystal layer in a state in which a predetermined electric field is applied thereto.

Of the light emerging from the reflective liquid crystal modulation element 400 in the direction of the arrow OW, a light component with a polarization direction perpendicular to the sheet of FIG. 1 (an S-polarized light component with respect to the polarization beam splitter 401) is reflected by the polarization beam splitting surface 401*a* and returned toward the light source in the direction of the arrow BW. On the other hand, a light component with a polarization direction in parallel with the sheet of FIG. 1 (a P-polarized light component with respect to the polarization beam splitter 401) is transmitted through the polarization beam splitting surface 401*a* in the direction of the arrow MW.

The amount of the light, or the optical transfer rate R(λ) of the light reflected by the reflective liquid crystal modulation element 400 and transmitted through the polarization beam splitter 401 in the direction of the arrow MW is expressed by the following expression (2):

$$R(\lambda)=0.5\ \{1-\cos\delta(\lambda)\} \quad (2)$$

where δ(λ) represents the abovementioned phase difference. The reflectance for S-polarized light and the transmittance for P-polarized light in the polarization beam splitter 401, the aperture ratio and the reflectance for non-polarized light of the reflective liquid crystal modulation element 400 are set to 100%.

Modulation of the electric field applied to the liquid crystal layer causes liquid crystal molecules to move from a tilt angle substantially perpendicular to substrates on both sides of the liquid crystal layer to a tilt angle substantially parallel to the substrates. As a result, the anisotropy of refractive index Δn is apparently changed. The phase difference δ(λ) is changed from δ≈0 to δ≈90 degrees.

Next, description will be made of the basic structure of an energy band (energy potential) within the reflective liquid crystal modulation element with reference to FIG. 2. In the reflective liquid crystal modulation element, an electric field is applied to the liquid crystal layer through an ITO transparent electrode disposed on the entrance and emergence side of light and a metallic mirror electrode serving as an electrode and a mirror surface. The metallic mirror electrode is primarily made of aluminum or an alloy of aluminum.

Figure 2:
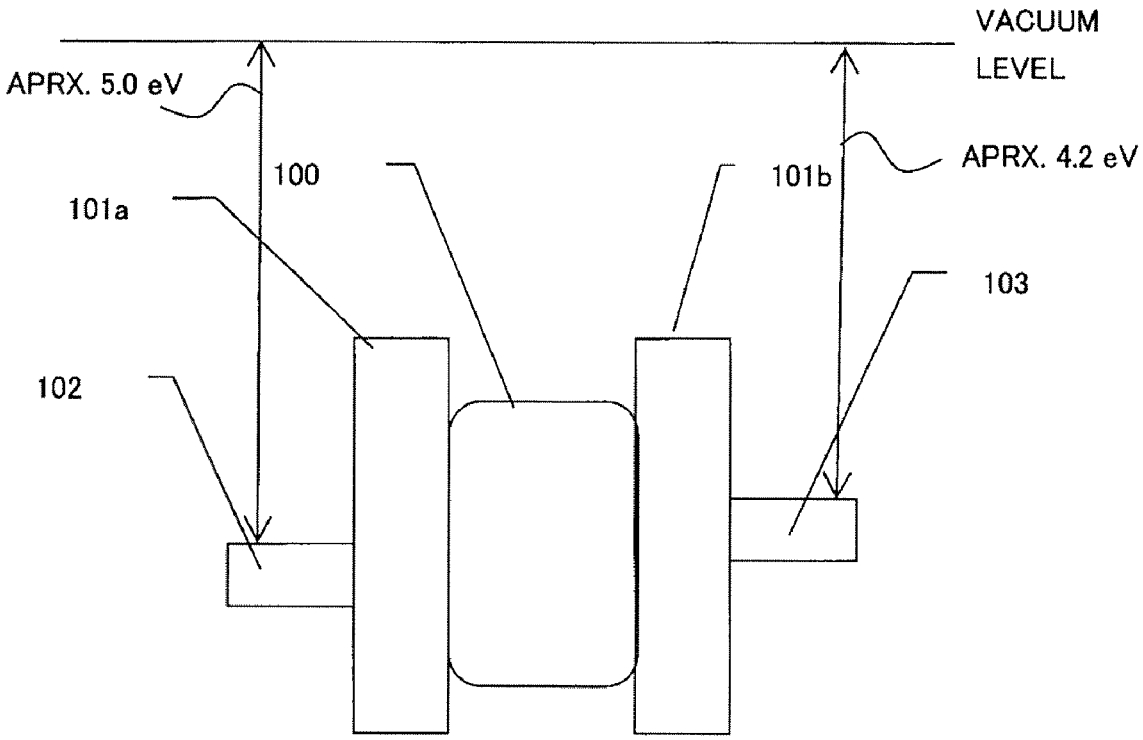
FIG. 2 is a figure for explaining the energy potential configuration of the reflective liquid crystal modulation element.

In FIG. 2, reference numeral 102 shows the ITO transparent electrode, and 103 the metallic mirror electrode made of aluminum. Reference numeral 100 shows the liquid crystal layer, 101*a* and 101*b* obliquely-evaporated porous liquid crystal alignment films for providing VAN liquid crystal alignment. The liquid crystal alignment films 101*a* and 101*b* are made of inorganic non-conductive material predominantly composed of silicon oxide.

The liquid crystal layer 100 is sandwiched between the liquid crystal alignment films 101*a* and 101*b*. The reflective liquid crystal modulation element has the basic structure in which the ITO transparent electrode 102 and the metallic mirror electrode 103 are in contact with the outside thereof. The vertical direction in FIG. 2 represents the level of the energy potential, and the vacuum level is present in the upper position.

Since the work function energy of the ITO transparent electrode 102 from the vacuum level is approximately 5.0 eV and that of the aluminum metallic mirror electrode 103 is approximately 4.2 eV, they have an energy potential difference of approximately 0.8 eV in their materials.

The Fermi levels of the liquid crystal layer 100 that is a non-conductive insulator and the liquid crystal alignment films 101*a* and 101*b* made of silicon oxide are locked to be equal to the energy potential level of aluminum which has substantially equal electron mobility and hole mobility.

It is difficult to directly measure the widths of the energy bands of the liquid crystal alignment films 101*a* and 101*b* made of porous silicon oxide. The width of the energy band of silicon oxide ranges from approximately 6 to 9 eV depending on the property of the film. Approximately 6 eV is assumed herein in view of the porous structure.

Thus, between the mirror electrode 103 made of aluminum, the liquid crystal layer 100, and the liquid crystal alignment film 101*a*, the energy for excitation trapping of electrons is assumed as approximately 3 eV and the energy for excitation trapping of holes is also assumed as approximately 3 eV.

In contrast, between the ITO transparent electrode 102, the liquid crystal layer 100, and the liquid crystal alignment film 101*b*, the energy for excitation trapping of electrons is assumed as approximately 3.8 eV, while the energy for excitation trapping of holes is assumed as approximately 2.2 eV.

As described above, the energy band of the reflective liquid crystal modulation element has the basic structure as shown in FIG. 2. However, this energy band structure has unbalanced excitation charge-up of electrons and holes. Therefore, a DC electric field between the opposite alignment films on both sides of the liquid crystal layer is drastically increased due to the charge-up with increase of time of use of the liquid crystal modulation element.

Figure 3:
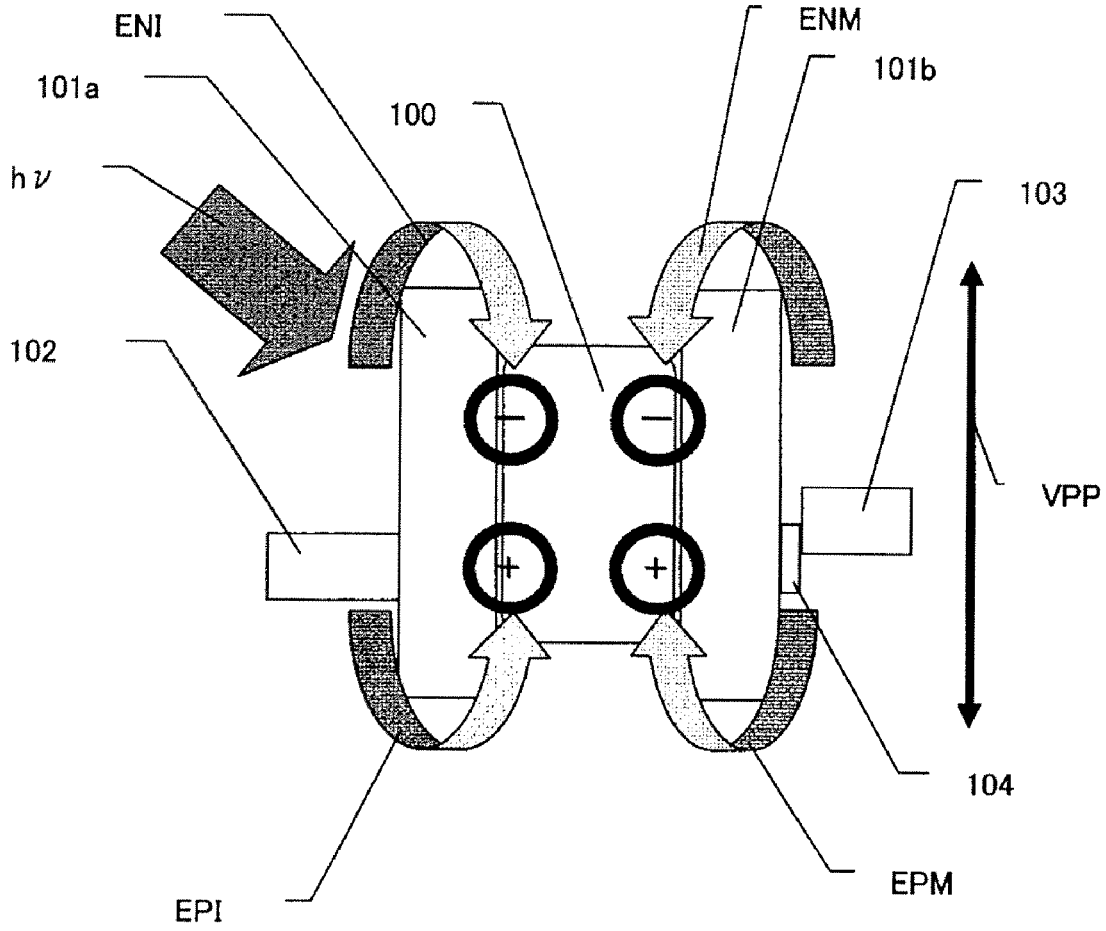
FIG. 3 is a figure for explaining a charge-up phenomenon in the liquid crystal interface layer of the liquid crystal modulation element.

Japanese Patent Laid-Open No. 2005-49817 described above has disclosed a method shown in FIG. 3 to overcome the problem. FIG. 3 shows a work-function adjusting film 104 made of nickel, rhodium, lead, platinum, or an oxide thereof having a work function larger than that of aluminum between the metallic mirror electrode 103 made of aluminum and the liquid crystal alignment film 101*b*. This brings the work function of the metallic mirror electrode 103 close to the work function of the ITO transparent electrode 102.

In FIG. 3, ENI and ENM show excitation of electrons. EPI and EPM show excitation of holes. ENI and EPI show excitation from the ITO transparent electrode (102) side. ENM and EPM show excitation from the metallic mirror electrode (103) side.

According to the structure in FIG. 3, the electrons and holes are excited from the electrodes 102 and 103 at substantially the same excitation probability. For this reason, charge-up amounts with the electrons and holes trapped by the liquid crystal layer 100 and liquid crystal alignment films 101*a* and 101*b* are the same on both side of the electrodes. This can avoid occurrence of an electric field between the ITO transparent electrode 102 and the metallic mirror electrode 103.

During operation of the liquid crystal modulation element, an electric field indicated by the arrow VPP in FIG. 3 is applied to the metallic mirror electrode 103 as a field inversion drive potential (AC component). This electric field distorts the energy potential. The excitation probability of electrons or holes varies with the amounts of the light energy and the photon energy indicated by the arrow hν in FIG. 3.

It is contemplated that the improved structure of the liquid crystal modulation element as described above may prevent flicker or sticking at the early stages of use of the liquid crystal modulation element.

However, in practice, the value of the work function on the ITO transparent electrode side and that on the metallic mirror electrode side, that is, the energy potentials thereof do not coincide with each other because of limitations of the material of the work-function adjusting film 104 and variations of manufacturing conditions thereof, and have a difference of approximately 0.1 eV therebetween.

This difference causes gradual accumulation of the trapped charges on the liquid crystal alignment films 101*a* and 101*b* with increase of time of use of the liquid crystal modulation element for a long term. In addition, the unbalanced excitation probability generates an electric field between the ITO transparent electrode 102 and the metallic mirror electrode 103. Thus, in a long-term view, visible flicker and sticking occur. It should be noted that the above-mentioned 'visible flicker' means flicker having a level of being easily-observable to human eyes or a level of causing discomfort to human. The 'visible flicker' does not mean flicker having a level of being hardly-observable to human eyes and not causing discomfort to human while it is visible.

Embodiment 1

Embodiment 1 of the present invention will hereinafter be described with reference to FIGS. 4, 5A, and 6 to 9.

Figure 4:
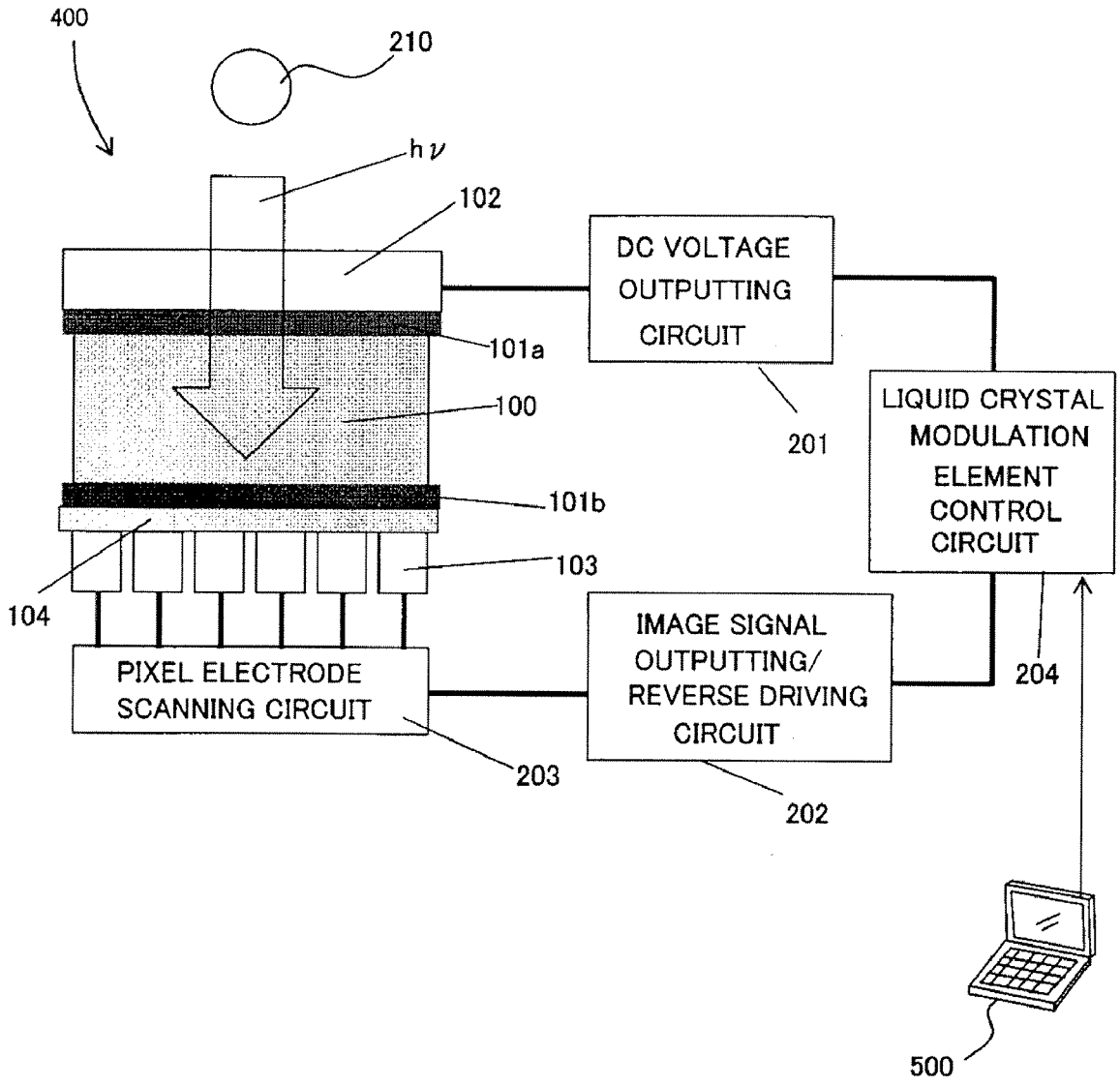
FIG. 4 is a figure for explaining the structure of the liquid crystal modulation element in Embodiments 1 to 6 of the present invention.

FIG. 4 shows the configuration of a circuit which controls the voltages to be applied to the ITO transparent electrode 102 and the metallic mirror electrode 103 in the liquid crystal modulation element 400, which is the basic configuration of the liquid crystal display apparatus that is Embodiment 1 of the present invention. The configuration of the liquid crystal modulation element 400 and the materials of each electrode and each alignment film are the same as those in the above described premised technology.

Reference numeral 201 shows a DC voltage outputting circuit, 202 an image signal outputting/reverse driving circuit, 203 a pixel electrode scanning circuit, and 204 a liquid crystal modulation element control circuit as a controller.

The liquid crystal modulation element control circuit 204 controls the DC voltage outputting circuit 201. The DC voltage outputting circuit 201 applies a predetermined DC voltage to the ITO transparent electrode 102.

The liquid crystal modulation element control circuit 204 outputs signals to the image signal outputting/reverse driving circuit 202 based on image information supplied from an image supply apparatus 500, such as a personal controller, DVD player, and a television tuner. The image supply apparatus 500 and the liquid crystal display apparatus constitute an image display system.

The image signal outputting/reverse driving circuit 202 outputs a predetermined alternate voltage to the pixel electrode scanning circuit 203 based on signals from the liquid crystal modulation element control circuit 204. The pixel electrode scanning circuit 203 applies an alternate voltage in accordance with the alternate voltage from the image signal outputting/reverse driving circuit 202 to the metallic mirror electrode 103.

Thereby, an alternate voltage with a rectangular-wave shape, which changes between a positive state and a negative state with respect to the voltage applied to the ITO transparent electrode in a certain cycle, is applied to the metallic mirror electrode 103.

Each of the voltages to be applied to each electrode and the liquid crystal layer 100 in this embodiment means the electric potential referenced to ground (0V), not shown, that is, the potential difference with respect to the ground. In addition, the central value of the alternate voltage to be applied to the metallic mirror electrode 103 is referred to as the central potential. However, in the description below, the central potential to be applied to the metallic mirror electrode 103 is simply referred to as the potential to be applied to the metallic mirror electrode 103. Further, in the description below, the ITO transparent electrode side edge of the liquid crystal layer 100 is simply referred to as the ITO electrode side edge, and the metallic mirror electrode side edge of the liquid crystal layer 100 is simply referred to as the mirror electrode side edge.

Reference numeral 210 shows a light source which emits illumination light hν that is irradiated on the liquid crystal modulation element 400.

Figure 8:
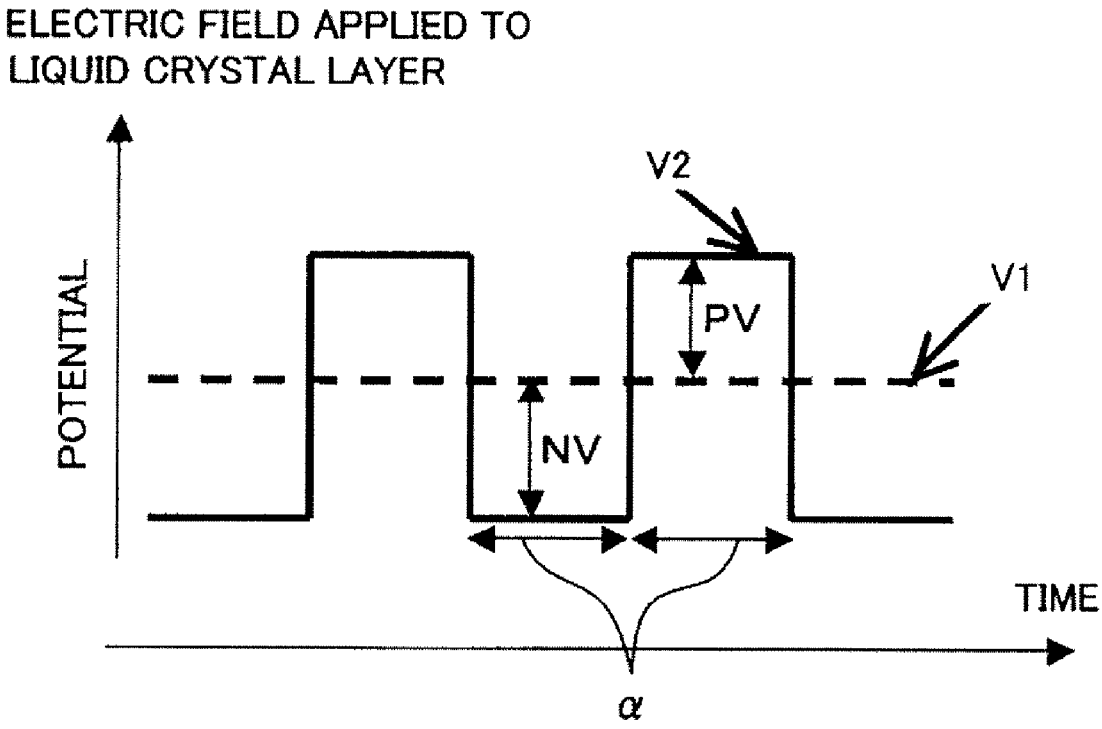
FIG. 8 is a figure for explaining effective electric fields in the liquid crystal layer.

FIG. 8 shows effective electric fields generated in the liquid crystal layer 100 via the metallic mirror electrode 103 and the ITO transparent electrode 102. The lateral axis represents time, and the vertical axis represents the effective electric field (potential difference) in the liquid crystal layer 100.

The electric field that is applied to the mirror electrode side edge of the liquid crystal layer 100 via the metallic mirror electrode 103 is an alternate electric field V2 with a certain period α, shown by the solid line. The electric field that is applied to the ITO electrode side edge of the liquid crystal layer 100 via the ITO transparent electrode 102 is a DC electric field V1, shown by the dashed line.

The effective electric field in the liquid crystal layer 100 is generated in accordance with the difference between these alternate electric field and DC electric field, and alternately switches between an electric field PV with positive polarity and an electric field NV with negative polarity with the certain period α. In the description below, the electric field PV with positive polarity and the electric field NV with negative polarity are simply referred to as the positive electric field PV and the negative electric field NV, respectively.

The certain period α corresponds to 1/120 sec. in NTSC system and 1/100 sec. in PAL system, each of which corresponds to a period of one field. One frame image is displayed in two field periods (1/60 sec. or 1/50 sec.). The certain period α may correspond to a displaying period of one frame image.

Each of the positive electric field PV and the negative electric field NV is generated by superposing all of the voltage drops and minute electric fields on the electric field applied to each of the electrodes 102 and 103, the voltage drops being caused by resistances of the alignment films provided at the interfaces of the electrode and liquid crystal, and the minute electric field being generated by the trapped charges or the like.

The liquid crystal modulation element control circuit 204 includes a computer program and has a function of controlling the DC voltage outputting circuit 201 depending on time of use of the liquid crystal modulation element 400 according to the computer program.

The time of use of the liquid crystal modulation element 400 used herein means the accumulated time length of the operation for modulating light that enters the element from the light source. The time of use of the liquid crystal modulation element 400 can be reworded as the accumulated time of use of the liquid crystal display apparatus (that is, the accumulated time length of the operation for displaying images).

The description will hereinafter be made of the control of the DC voltage outputting circuit 201 performed by the liquid crystal modulation element control circuit 204, that is, the control of the DC voltage to be applied to the ITO transparent electrode 102 via the DC voltage outputting circuit 201 with reference to FIG. 5A.

Figure 5A:
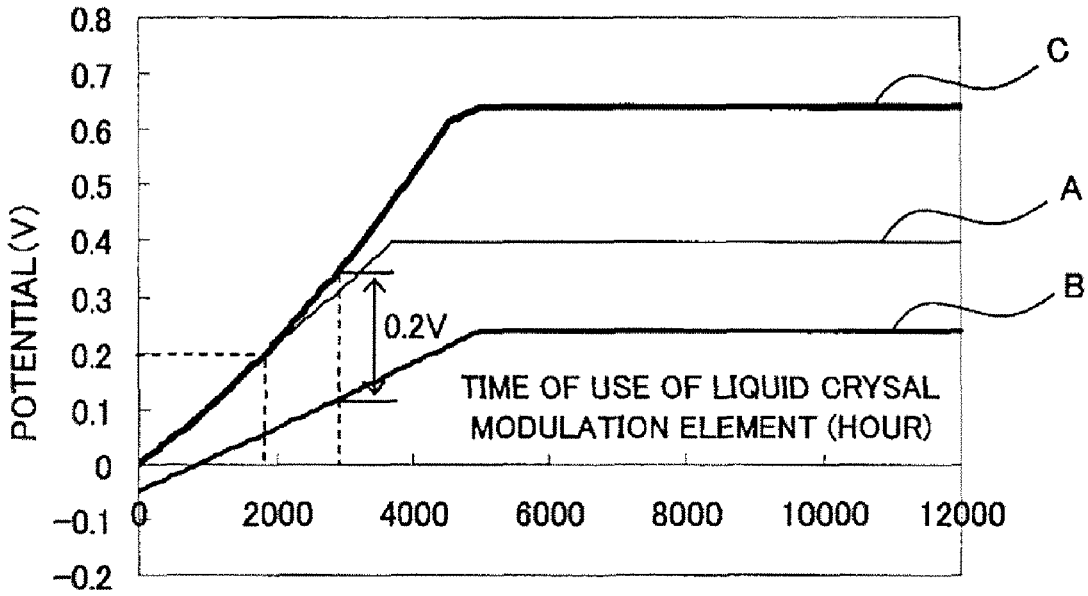
FIG. 5A is a graph for explaining the potential to be applied to the liquid crystal modulation element and a minimum flicker ITO electrode potential in Embodiment 1.

The graph A in FIG. 5A shows the change with time of the potential which is needed to be applied to the ITO transparent electrode 102 to minimize the flicker (hereinafter, referred to as the minimum flicker ITO electrode potential) when the potential applied to the ITO transparent electrode 102 is equal to the potential applied to the metallic mirror electrode 103.

The 'flicker' used in this embodiment and other embodiments, described later, includes variations of light amount which are not sensed by (invisible to) human eyes.

In addition, as described above, the flicker that can be easily sensed by human eyes occurs when the difference between the absolute values of the positive and negative electric fields PV and NV is more than 400 mV. Conversely, to make the flicker invisible to human eyes, it is preferable that the difference between the absolute values of the positive and negative electric fields PV and NV is suppressed to be equal to or smaller than 400 mV (more preferably, equal to or smaller than 300 mV, still more preferably, equal to or smaller than 200 mV). This corresponds to that the difference between the potential of the ITO transparent electrode, described later, and the minimum flicker ITO electrode potential is equal to or lower than 200 mV (preferably, equal to or lower than 150 mV, still more preferably, equal to or lower than 100 mV).

In the conventional technique, the same potential as the minimum flicker ITO electrode potential (0V) at the early stages of time of use is continuously applied to the ITO transparent electrode 102 during time of use of the liquid crystal modulation element.

The graph A was made by plotting the average values of the results of measurements of the minimum flicker ITO electrode potentials, the measurements being performed on the plural liquid crystal modulation elements with the same configuration. The peak value of the alternate voltage to be applied to the metallic mirror electrode 103 was fixed.

Figure 9:
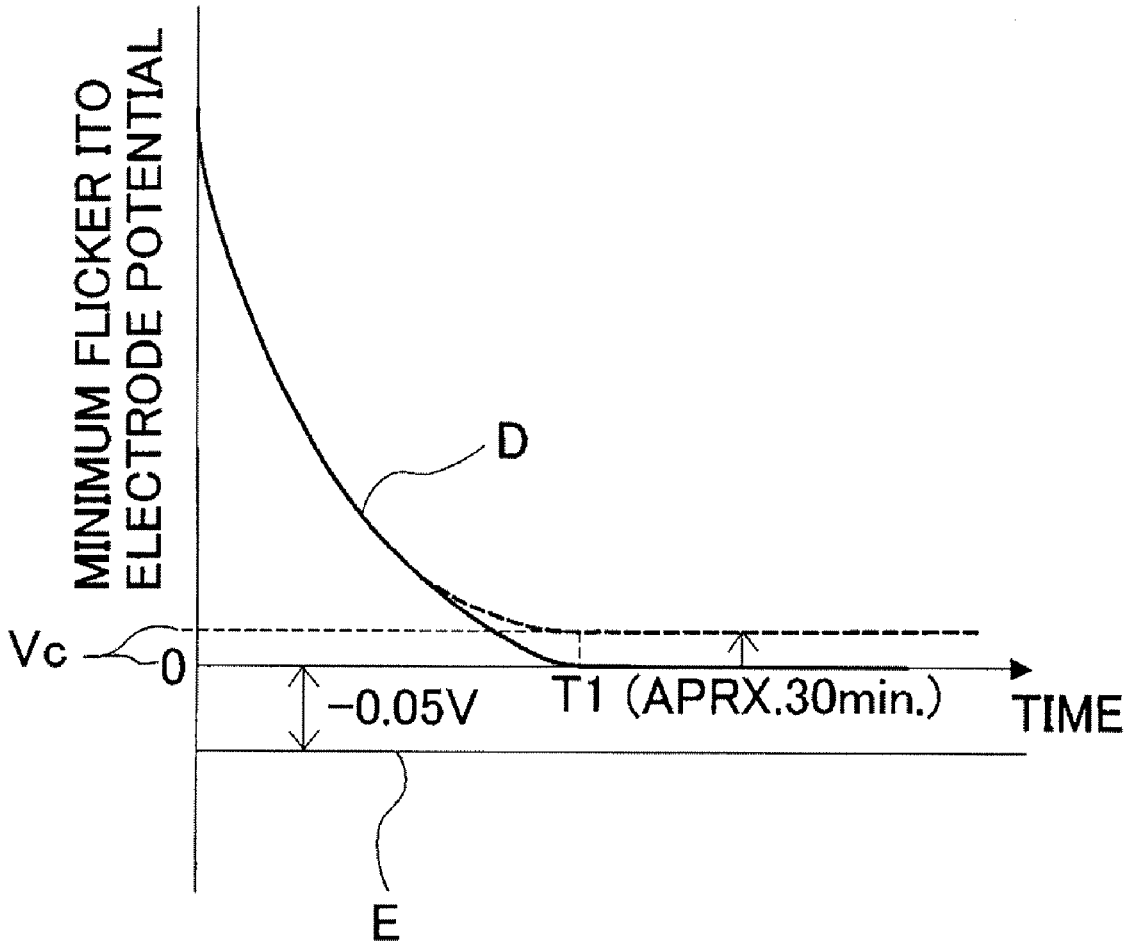
FIG. 9 is a graph for explaining the minimum flicker ITO electrode potential of the liquid crystal modulation element in a short term.

Liquid crystal modulation elements generally have a characteristic in which, in every use thereof, the minimum flicker ITO electrode potential reduces until a time T1 after a lapse of about 30 minutes from the start of use (start of light modulation operation) and becomes a steady-state value Vc after the time T1 as shown by the graph D in FIG. 9. At the early stages of time of use of the liquid crystal modulation element, for example at the first use, the steady-state minimum flicker ITO electrode potential Vc is 0V.

The above-described change with time of the minimum flicker ITO electrode potential means that the steady-state minimum flicker ITO electrode potential Vc in every use changes (increases) as the number of times of use increases, that is, as the time (hours) of use of the liquid crystal modulation element increases.

In FIG. 5A, the point of time when the minimum flicker ITO electrode potential becomes a steady-state value at the early stages of time of use of the liquid crystal modulation element is defined as zero hour. The graph A shows the change with time of the minimum flicker ITO electrode potential after that zero hour.

For actual liquid crystal display apparatus, the first use used herein means the time of testing of the light modulation operation of the liquid crystal modulation element before shipment from the factory or the time of performing of the light modulation operation of the liquid crystal modulation element for displaying images at a shop or by a user after the shipment.

The early stages used herein include the above-described first use and a predetermined time period after the start of use, such as 10 hours or 100 hours. This is also applied to the graphs B, C in this embodiment and the later-described Embodiments 2, 4 to 6.

In the conventional technique, as will be understood from the graph A, the minimum flicker ITO electrode potential increases by approximately 200 mV (0.2V) from that (0V) at the early stages of use at the point of time when the liquid crystal modulation element is operated for approximately 2,000 hours. Further, it increases more than 300 mV at the point of time when the liquid crystal modulation element is operated for approximately 3,000 hours.

If a potential different from the minimum flicker ITO electrode potential by 200 mv or more is applied to the ITO transparent electrode 102, the level of the flicker reaches a level of being easily visible particularly in the region of green light with a high relative visibility.

In addition, the sticking characteristic significantly deteriorates relative to that at the first use. Therefore, if the same potential as the minimum flicker ITO electrode potential (0V) at the early stages of use is continuously applied to the ITO transparent electrode 102 during the time of use, the lifetime of the liquid crystal modulation element is shortened to approximately 2,000 hours.

In contrast, in this embodiment, the DC voltage (DC potential) to be applied to the ITO transparent electrode 102 from the DC voltage outputting circuit 201 is controlled as shown by the graph B in FIG. 5A.

Controlling the potential to be applied to the ITO transparent electrode 102 means controlling the potential difference between the ITO transparent electrode 102 and the metallic mirror electrode 103.

In this embodiment, at the early stages of time of use, the DC potential to be applied to the ITO transparent electrode 102 is set to a potential lower than the minimum flicker ITO electrode potential (0V) by 50 mV (0.05V).

This means that the minimum flicker ITO electrode potential shown by the graph A has a characteristic of monotonically changing in the plus direction (certain direction) with increase of time of use and that the potential to be applied to the ITO transparent electrode 102 is shifted in the minus direction (the direction opposite to the certain direction) with respect to the potential to be applied to the metallic mirror electrode 103.

The 'monotonical change' means a continuous change in a certain direction (a temporal stop thereof is allowed) and includes a change that does not substantially change in the direction opposite to the certain direction. Herein, the liquid crystal modulation element is regarded as having the above-described characteristic if the steady-state minimum flicker ITO electrode potential does not change in the minus direction.

In addition, in this embodiment, the potential difference between both the electrodes 102 and 103 is set to a value different from a minimum flicker inter-electrode potential difference, which is the potential difference between both the electrodes 102 and 103 for minimizing the flicker, such that the potential of the ITO transparent electrode 102 is lower than the minimum flicker ITO electrode potential by 50 mV.

Furthermore, in this embodiment, as shown by the graph E in FIG. 9, the potential lower than the minimum flicker ITO electrode potential by 50 mV is applied to the ITO transparent electrode 102 from the start of the first use (that is, from the point of time when light from the light source first enters the liquid crystal modulation element at the first use).

The definition of the minimum flicker ITO electrode potential (minimum flicker inter-electrode potential difference) of the liquid crystal modulation element will be clarified. The minimum flicker ITO electrode potential depends on various extra factors such as the illumination light intensity.

For example, when the liquid crystal modulation element is illuminated with high intensity light of about 3 mW/cm$^2$, the minimum flicker ITO electrode potential may change with time by about 200 mV in about 30 minutes. Considering such a case, the minimum flicker ITO electrode potential is defined as a steady-state potential which does not change in a short time of about a few minutes.

Specifically, the steady state means a state in which, when the minimum flicker ITO electrode potentials are continuously measured in 2 minutes, the difference of the average values of the minimum flicker ITO electrode potentials measured in the first 1 minute and the next 1 minute becomes equal to or smaller than 10 mV.

This steady-state minimum flicker ITO electrode potential is shown by the graph A in FIG. 5A. For general liquid crystal modulation elements, the value of 10 mV is a sufficient value as the steady-state value. However, this value may be 30 mV if considering a liquid crystal modulation element having singular characteristics.

Next, description will be made of the effect of the application of the potential lower than the minimum flicker ITO electrode potential to the ITO transparent electrode 102 at the early stages of time of use (hereinafter simply referred to as the early stages of use) with reference to FIG. 6

The application of the potential lower than the minimum flicker ITO electrode potential to the ITO transparent electrode 102 generates an imbalance between the positive electric field and the negative electric field in the liquid crystal layer. This asymmetric electric field causes a DC electric field VDC between both the electrodes 102 and 103 as shown by the arrow in FIG. 6.

Figure 6:
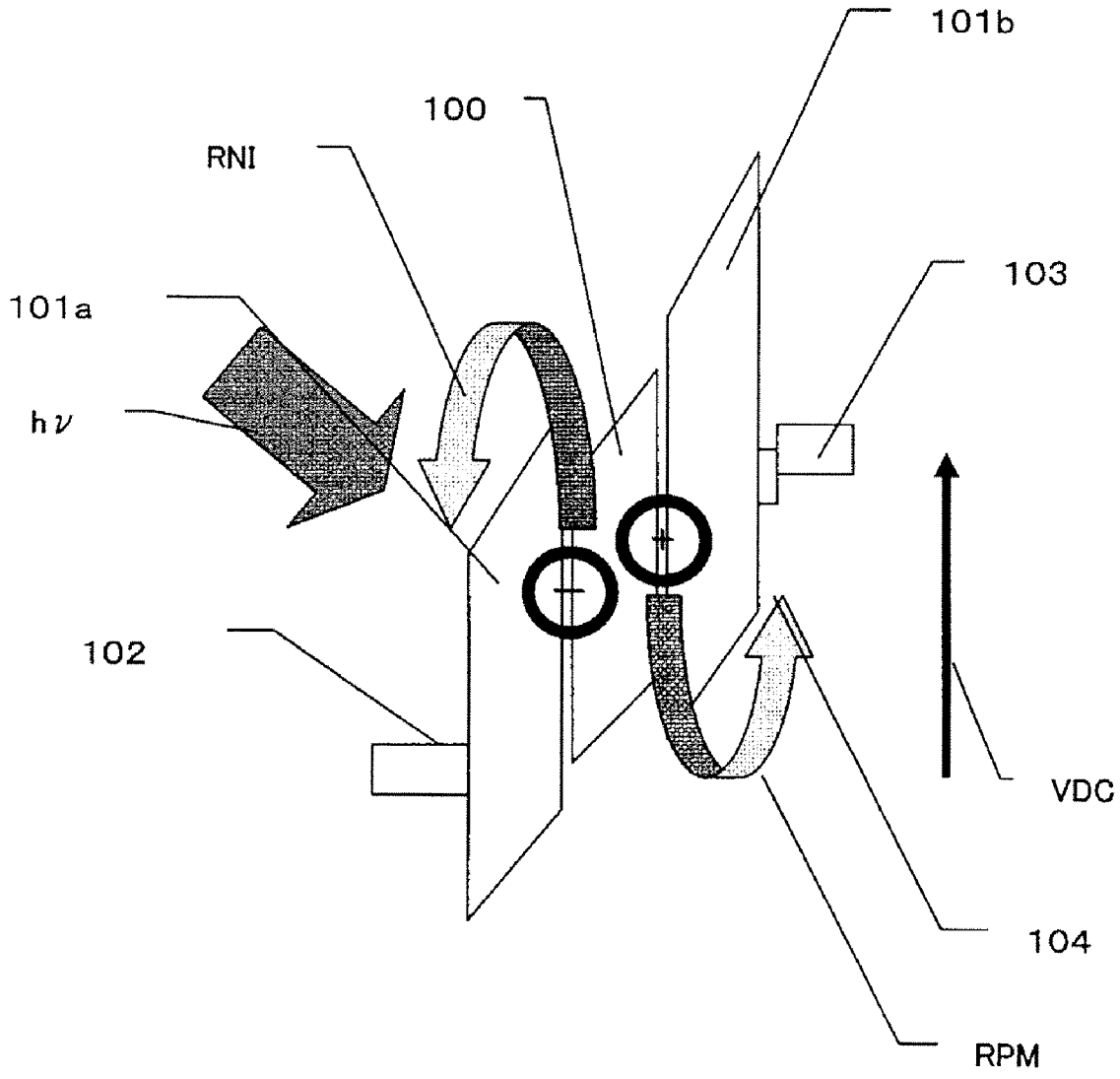
FIG. 6 is a figure for explaining a method for controlling the charge-up amount in the liquid crystal interface layer of the liquid crystal modulation element in Embodiments 1 and 2.

FIG. 6 shows energy potentials distorted due to this DC electric field.

When the light hν enters the liquid crystal modulation element in this state, in the vicinity of the interface between the liquid crystal layer 100 and the liquid crystal alignment film 101*a*, electrons which are trapped with use of the liquid crystal modulation element are forcibly excited by the light hν as shown by the arrow RNI.

These electrons are removed to the ITO transparent electrode side by the inclination of energy level due to the application of the electric field. On the other hand, holes trapped in the vicinity of the interface between the liquid crystal layer 100 and the liquid crystal alignment film 101*b* are forcibly excited by the light hν as shown by the arrow RPM. These holes are removed to the metallic mirror electrode side by the inclination of energy level due to the application of the electric field.

In other words, the charges which are trapped at the vicinity of the interfaces between the liquid crystal layer 100 and the liquid crystal alignment films 101*a* and 101*b* are excited and moved to be removed to the electrodes 102 and 103, thereby reducing the difference of the positive and negative electric fields generated in the liquid crystal layer 100.

These effects can reduce the accumulating speed of the charges charged up at the vicinity of the interfaces between the liquid crystal layer 100 and the liquid crystal alignment films 101*a* and 101*b*.

The potential to be applied to the ITO transparent electrode 102 at the early stages of use is preferably a potential having a difference smaller than 200 mV from the minimum flicker ITO electrode potential. This is because the difference equal to or larger than 200 mV makes the flicker of green light with a high relative visibility visible. In a case where only red light or blue light with a low relative visibility enters the liquid crystal modulation element, the potential to be applied to the ITO transparent electrode 102 is preferably a potential having a difference smaller than 250 mV from the minimum flicker ITO electrode potential.

On the other hand, the minimum potential to be applied to the ITO transparent electrode 102 at the early stages should be a potential which provides a difference of 30 mV or more between the absolute values of the positive and negative potential differences in the liquid crystal layer 100 in view of individual differences of liquid crystal modulation elements. This is because that difference makes it possible to obtain the above-mentioned effect. In this case the difference of the potential to be applied to the ITO transparent electrode 102 from the minimum flicker ITO electrode potential is 15 mV.

In this embodiment, to surely obtain the above-described effect, the potential to be applied to the ITO transparent electrode 102 at the early stages of use is set to a potential lower than the minimum flicker ITO electrode potential by 50 mV. Since the potential difference of 50 mV is smaller than 200 mV, the potential lower than the minimum flicker ITO electrode potential by 50 mV does not cause the flicker.

The liquid crystal modulation element has a characteristic in which the absolute value of the positive potential difference in the liquid crystal layer 100 changes in a direction of becoming larger than the absolute value of the negative potential difference with increase of time of use thereof.

There is, of course, a case where the liquid crystal modulation element has a characteristic in which the absolute value of the positive potential difference in the liquid crystal layer 100 changes in a direction of becoming smaller than the absolute value of the negative potential difference. However, description will be made of the case where it changes in the direction of becoming larger in this embodiment.

In this embodiment, at the early stages of use, the potential to be applied to the ITO transparent electrode 102 is shifted in a direction of making the above-mentioned absolute value of the positive potential difference larger than that of the negative potential difference.

For example, the potential to be applied to the ITO transparent electrode 102 is shifted in the minus direction (or the potential to be applied to the metallic mirror electrode 103 is shifted in the plus direction) such that the absolute value of the positive potential difference becomes larger than that of the negative potential difference.

In other words, when an imbalance is generated in which the positive electric field PV shown in FIG. 8 is larger than the negative electric field NV due to a long time of use of the liquid crystal modulation element, the electric field is set such that the positive electric field PV becomes larger than the negative electric field NV in the early stages of use thereof.

However, depending on conditions such as the film configuration of the liquid crystal modulation element and the amount of illumination light, the absolute value of the negative potential difference in the liquid crystal layer changes in a direction of becoming larger than that of the positive potential difference with increase of time of use thereof.

In this case, at the early stages of use, the potential to be applied to the ITO transparent electrode 102 is shifted in a direction of making the above-mentioned absolute value of the negative potential difference larger than that of the positive potential difference.

In other words, when an imbalance is generated in which the positive electric field PV is smaller than the negative electric field NV, the electric field is set such that the positive electric field PV becomes smaller than the negative electric field NV at the early stages of use thereof.

In addition, in this embodiment, the potential difference provided between the electrodes 102 and 103 is changed such that the sum of the absolute values of the above-described positive and negative potential differences in the liquid crystal layer 100 is constant.

This makes it possible to prevent the image brightness of the liquid crystal modulation element from fluctuating due to variations of the absolute values of the positive and negative potential differences.

Furthermore, when the liquid crystal modulation element has a characteristic in which the minimum flicker ITO electrode potential (that is, the minimum flicker inter-electrode potential difference) becomes a steady-state value after changing in every use, the following description can be made about this embodiment.

In this embodiment, at the point of time when the minimum flicker ITO electrode potential becomes a steady-state value in every use, the potential different from the steady-state minimum flicker ITO electrode potential is applied to the ITO transparent electrode 102.

In other words, at the point of time when the minimum flicker inter-electrode potential difference becomes steady-state value, the potential difference provided between the ITO transparent electrode 102 and the metallic mirror electrode 103 is controlled such that the provided potential difference is different from the steady-state minimum flicker inter-electrode potential difference.

However, the above-described voltage setting at the early stages of use cannot completely suppress the accumulation of the charges charged up with the increase of time of use.

Accordingly, in this embodiment, the potential to be applied to the ITO transparent electrode 102 is increased at a speed of approximately 0.6 mV per hour with increase of time of use of the liquid crystal modulation element.

In other words, the potential difference provided between the ITO transparent electrode 102 and the metallic mirror electrode 103 is controlled such that the potential difference is changed to follow the minimum flicker ITO electrode potential changing with time.

In this embodiment, the minimum output voltage resolution of the DC voltage outputting circuit 201 is about 3 mV, and the resetting of the potential difference between the ITO transparent electrode 102 and the metallic mirror electrode 103 is performed every about 5 hours. This suppresses the change with time of the difference of the absolute values of the above-described positive and negative potential differences due to the trapped charges, thereby making it possible to suppress the flicker and the sticking over a long period of time.

The combination of the above-described voltage setting at the early stages of use and the above-described voltage following control causes the minimum flicker ITO electrode potential to change as shown by the graph C in FIG. 5A. When the difference between the graphs C and B increases to 200 mV (0.2V) or more, the flicker begins to be seen. Therefore, the above combination can expand the lifetime of the liquid crystal modulation element by about 700 hours from the conventional 2,000 hours.

In addition, when the time of use of the liquid crystal modulation element reaches 5,000 hours, the value of the minimum flicker ITO electrode potential changes by 450 mV from that at the early stages of use and becomes a steady-state value. Therefore, the voltage following control is ended at about 5,000 hours. The control described above can minimize a risk of generating the visible flicker.

The timing to change the potential to be applied to the ITO transparent electrode 102, that is, the potential difference provided between both the electrode 102 and 103 will be described. In this embodiment, since the change width of the potential difference provided between both the electrode 102 and 103 per one change is approximately 3 mV, no disturbance of displayed images occurs at the time of changing the potential difference.

Therefore, even during displaying of images, the potential difference is changed based on the arrival of predetermined timing to change it. If disturbance of images occurs due to the change of the potential difference, the potential difference may be changed when no image is displayed, for example, at the time of power on, at the time of power off, and during operation without input of image information. This timing to change the potential difference is also applied to Embodiment 2 described later.

Figure 7:
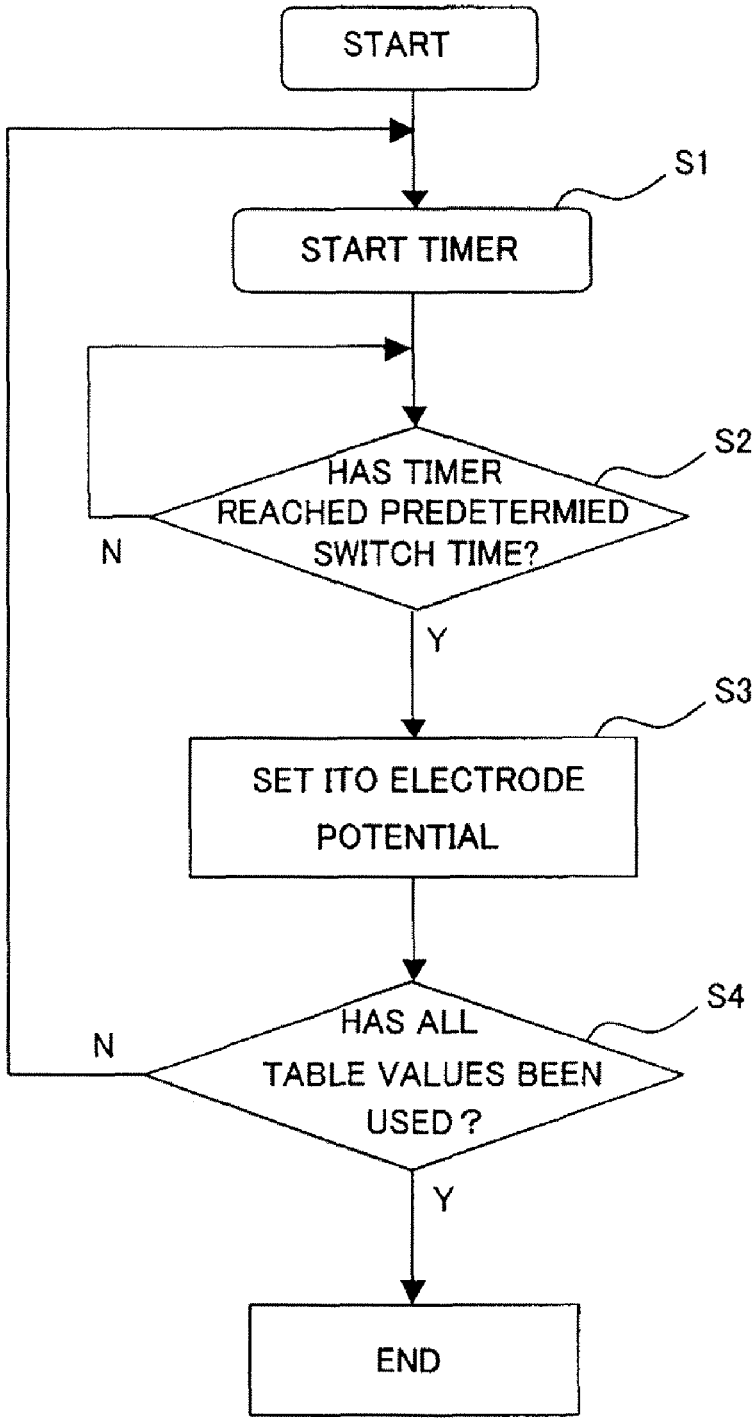
FIG. 7 is a flowchart showing the control process in Embodiment 1.

FIG. 7 is a flow chart showing processes according to the computer program provided in the liquid crystal modulation element control circuit 204.

At step (abbreviated to S in the figure) 1, the liquid crystal modulation element control circuit 204 starts a timer provided therein.

At step 2, the liquid crystal modulation element control circuit 204 determines whether or not the time counted by the timer reaches a predetermined potential changing time. When reaching the predetermined potential changing time, the process proceeds to step 3, while when not reaching the predetermined potential changing time, the liquid crystal modulation element control circuit 204 repeats step 2.

At step 3, the liquid crystal modulation element control circuit 204 reads out the ITO electrode potential data assigned to the potential changing time that has come, from the ITO electrode setting table stored in an inside memory, not shown. Further, the liquid crystal modulation element control circuit 204 controls the DC voltage outputting circuit 201 such that the DC voltage (DC potential) corresponding to the ITO electrode potential data is applied to the ITO transparent electrode 102.

At step 4, the liquid crystal modulation element control circuit 204 judges whether or not counting of all potential changing times to which the ITO electrode potential data are assigned has been completed (that is, whether or not all of the ITO electrode potential data have been used). If yes, the flow is ended. If no, a new timer count is started at step 1.

The charge-up speed in the liquid crystal modulation element depends on conditions for use of the liquid crystal modulation element (for example, the ambient temperature, the intensity or spectrum of the entering light, the difference between the potential applied to the ITO transparent electrode and the minimum flicker ITO electrode potential at the early stages of use). In addition, it also depends on the above-described difference between the absolute values of the positive and negative potential differences.

Therefore, it is recommended that measurements of the change amounts of the charge-up speed for various changes of the use condition be performed in advance and then the potential to be applied to the ITO transparent electrode 102, that is, the potential difference between both the electrodes 102 and 103 be changed (corrected) depending on changes of the use condition. This is also applied to Embodiment 2, described later.

Embodiment 2

Figure 5B:
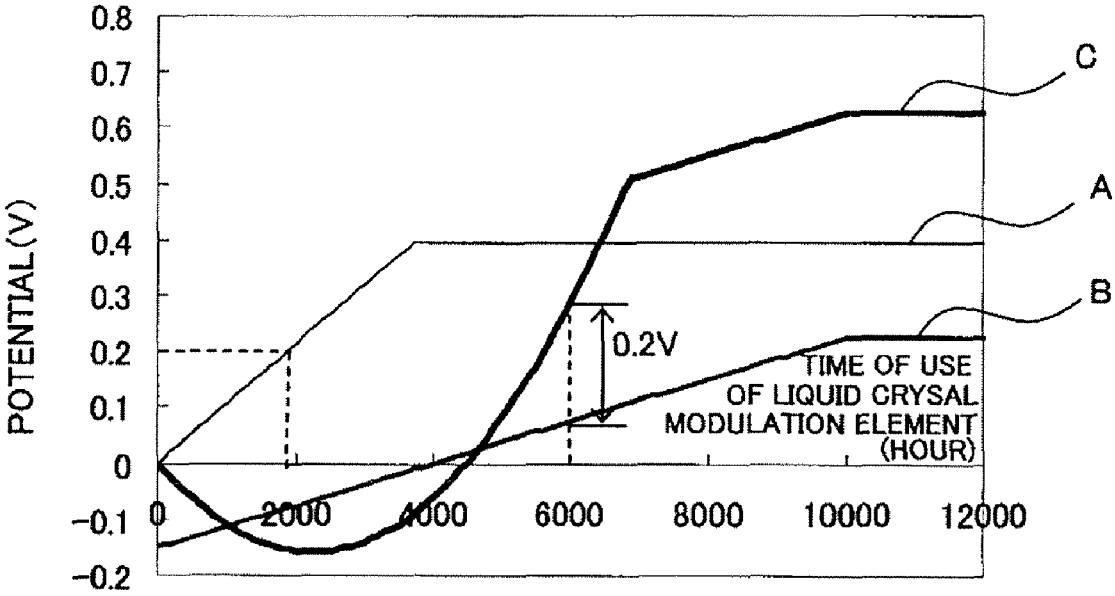
FIG. 5B is a graph for explaining the potential to be applied to the liquid crystal modulation element and the minimum flicker ITO electrode potential in Embodiment 2.

FIG. 5B shows the control of the application of a DC voltage to the ITO transparent electrode 102 by the liquid crystal modulation element control circuit 204 in the liquid crystal display apparatus that is Embodiment 2 of the present invention. The basic configuration of the liquid crystal display apparatus in this embodiment is identical to that in Embodiment 1. Components identical to those in Embodiment 1 are designated with the same reference numerals as those in Embodiment 1.

In FIG. 5B, the graph A shows the change with time of the minimum flicker ITO electrode potential when the potential applied to the ITO transparent electrode 102 is equal to the potential applied to the metallic mirror electrode 103. The graph B shows the potential to be applied to the ITO transparent electrode 102 in this embodiment. The graph C shows the change with time of the minimum flicker ITO electrode potential when the potential shown by the graph B is applied to the ITO transparent electrode 102.

In this embodiment, at the early stages of use, the DC voltage (DC potential) to be applied to the ITO transparent electrode 102 is set to a potential lower than the minimum flicker ITO electrode potential (0V) by 150 mV (0.15V).

In other words, at the early stages of use, the potential difference between both the electrodes 102 and 103 is set to a value different from the minimum flicker inter-electrode potential difference, which is the potential difference that is needed to be applied between both the electrodes 102 and 103 to minimize the flicker, such that the potential to be applied to the ITO transparent electrode 102 is lower than the minimum flicker ITO electrode potential by 150 mV.

The potential difference of 200 mV or more between the ITO transparent electrode 102 and the metallic mirror electrode 103 makes the flicker visible as described above. Therefore, the potential of the ITO transparent electrode 102 lower than the minimum flicker ITO electrode potential by 150 mV does not make the flicker visible.

The difference between the potential of the ITO transparent electrode 102 and the minimum flicker ITO electrode potential, which is a larger difference than that in Embodiment 1, provides an imbalance of the positive and negative electric fields generated in the liquid crystal layer 100 larger than that in Embodiment 1. Thereby, the DC electric field VDC generated between both the electrodes 102 and 103 (that is, in the liquid crystal layer 100) shown in FIG. 6 increases further.

This DC electric field further distorts the energy potential in the liquid crystal layer 100. Therefore, when the light hν enters the liquid crystal modulation element, the electrons trapped with use of the element are forcibly excited by the entering light hν, thereby increasing the amount of electrons that are removed to the ITO transparent electrode side.

In addition, of the holes trapped at the vicinity of the interface of the liquid crystal layer 100 and the liquid crystal alignment film 101*b*, the holes that are removed to the metallic mirror electrode side increases. This makes it possible to further reduce the accumulating speed of the charges charged up at the vicinity of the interfaces of the liquid crystal layer 100 and the liquid crystal alignment films 101*a* and 101*b* as compared with that in Embodiment 1.

In this embodiment, in addition to such a voltage setting at the early stages of use, the potential to be applied to the ITO transparent electrode 102 is increased at a slow speed of approximately 0.4 mV per hour with increase of time of use of the liquid crystal modulation element such that the potential to be applied to the ITO transparent electrode 102 is changed to follow the change of the minimum flicker ITO electrode potential. This makes it possible to suppress occurrence of the flicker and sticking over a long period of time as in Embodiment 1.

The combination of the above-described voltage setting at the early stages of use and the above-described voltage following control causes the minimum flicker ITO electrode potential to change as shown by the graph C in FIG. 5B. The flicker is invisible until the difference between the graphs C and B reaches 200 mV (0.2V), the flicker begins to be seen when the difference increases to 200 mV or more. Therefore, the above combination can expand the lifetime of the liquid crystal modulation element by about 4,000 hours from the conventional 2,000 hours.

In addition, when the time of use of the liquid crystal modulation element reaches 10,000 hours, the value of the minimum flicker ITO electrode potential changes by 600 mV from that at the early stages of use and then becomes a steady-state value. Therefore, the voltage following control is ended at about 10,000 hours. The control described above can minimize a risk of generating the visible flicker.

This embodiment is effective to suppress variations of the minimum flicker ITO electrode potential (that is, the minimum flicker inter-electrode potential difference), for example in a case where it varies widely during time of use of the liquid crystal modulation element.

The increasing speeds of the potential difference provided between both the electrodes 102 and 103, which were described in Embodiments 1 and 2, depend on parameters such as a wavelength of light entering the liquid crystal modulation element and a cooling temperature thereof.

In addition, the potential difference as a threshold value at which the flicker becomes visible depends on parameters relating to wavelengths such as red, green and blue.

Therefore, it is preferable to measure the characteristics of the individual liquid crystal modulation element installed in the liquid crystal display apparatus to determine the optimal parameters for performing the control described in each of embodiments 1 and 2.

Furthermore, when the curve showing the minimum flicker ITO electrode potential changing with time of use can be approximated by a nonlinear curve, it is preferable to set also the curve of the controlled potential of the ITO transparent electrode 102 as a nonlinear curve.

Moreover, the description was made of the case where DC voltage and AC voltage were applied to the ITO transparent electrode and the metallic mirror electrode, respectively, in each of Embodiments 1 and 2. However, when positive and negative electric fields are periodically generated in the liquid crystal layer in a certain cycle, AC voltages may be applied to both the electrodes. The same is applied to Embodiments 4 to 6 described later.

Embodiment 3

Figure 10:
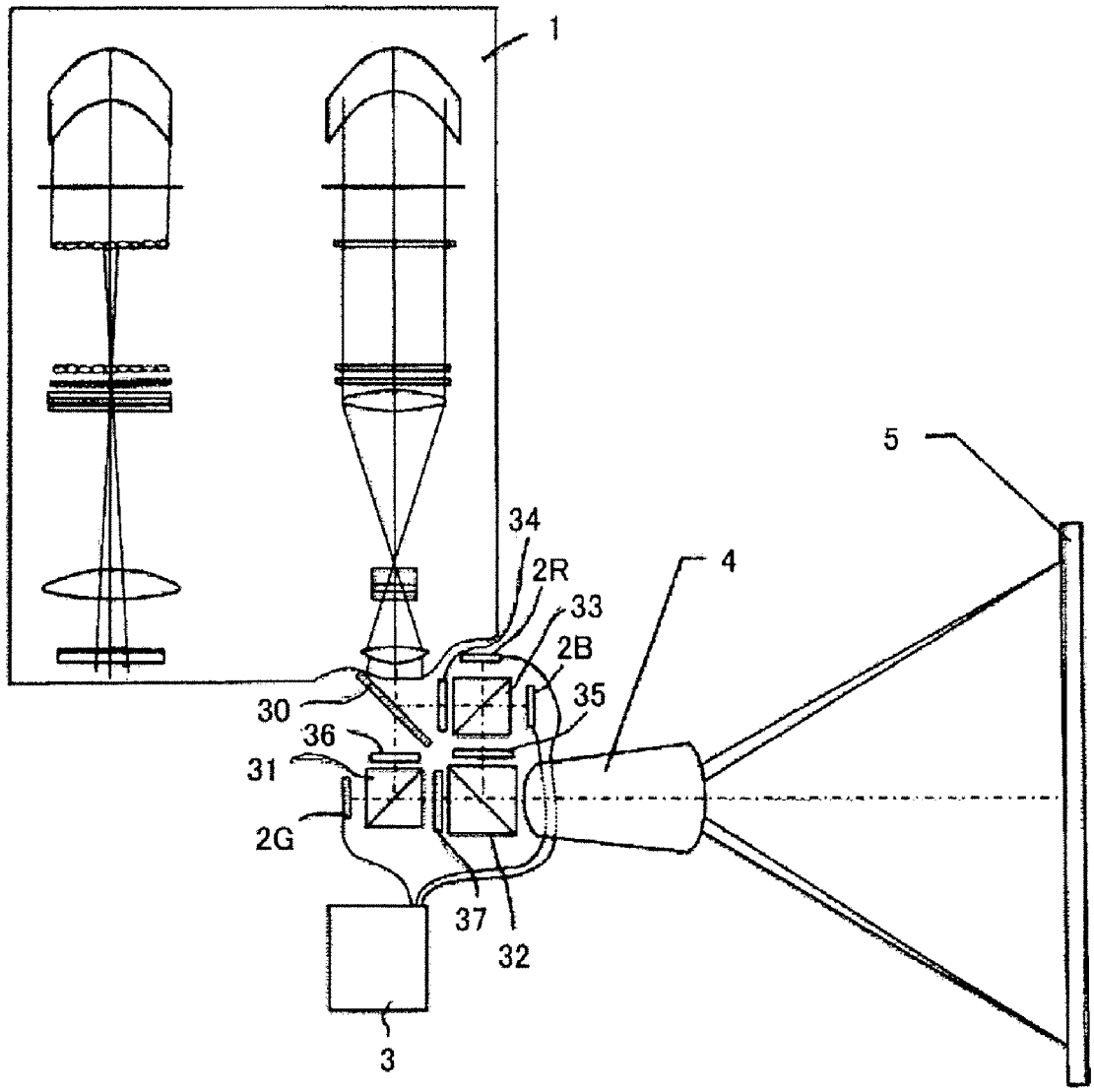
FIG. 10 is a schematic view showing the image projection apparatus that is Embodiment 3 of the present invention.

FIG. 10 shows a liquid crystal projector (image projection apparatus) that is one of the liquid crystal display apparatus described in Embodiments 1 and 2. FIG. 10 is a plane view (partially a side view) showing the optical configuration of the projector.

Reference numeral 3 shows a liquid crystal panel driver having functions of the liquid crystal modulation element control circuit 204, the image signal outputting/reverse driving circuit 202 and the pixel electrode scanning circuit 203, shown in FIG. 4. The liquid crystal panel driver 3 converts image information input from the image supply apparatus 500 shown in FIG. 4 into panel driving signals for red, green and blue.

The panel driving signals for red, green and blue are input to a red liquid crystal panel 2R, a green liquid crystal panel 2G and a blue liquid crystal panel 2B, respectively. Thereby, the three liquid crystal panels 2R, 2G and 2B are driven independently from each other. Each liquid crystal panel is a reflective liquid crystal modulation element.

Reference numeral 1 shows an illumination optical system. The plane view of the illumination optical system 1 is shown on the left in the frame in the figure, and the side view thereof is shown on the right. The illumination optical system 1 includes a light source lamp, a parabolic reflector, a fly-eye lens, a polarization conversion element, a condenser lens and the like, and emits illumination light as linearly polarized light (S-polarized light) with the same polarization direction.

The illumination light from the illumination optical system 1 impinges on a dichroic mirror 30 which reflects light of magenta color and transmits light of green color. The magenta component of the illumination light is reflected by the dichroic mirror 30 and then transmitted through a blue cross color polarizer 34 which provides a half-wave retardation to polarized light of blue color. Thereby, linearly polarized light (P-polarized light with a polarization direction parallel to the sheet of the figure) of blue color and linearly polarized light (S-polarized light with a polarization direction orthogonal to the sheet) of red color are generated.

The P-polarized light of blue color enters a first polarization beam splitter 33 and is then transmitted through its polarization beam splitting film to reach the blue liquid crystal panel 2B. The S-polarized light of red color is reflected by the polarization beam splitting film of the first polarization beam splitter 33 to reach the red liquid crystal panel 2R.

S-polarized light of green color transmitted through the dichroic mirror 30 is transmitted through a dummy glass 36 for correcting the optical path length of green color and then enters a second polarization beam splitter 31. The S-polarized light of green color is reflected by the polarization beam splitting film of the second polarization beam splitter 31 to reach the green liquid crystal panel 2G.

As described above, the red, green and blue liquid crystal panels 2R, 2G and 2B are illuminated with the illumination light.

The light that entered each liquid crystal panel is provided with a retardation of polarization depending on the modulation state of pixels arranged in the liquid crystal panel and reflected by the liquid crystal panel to emerge therefrom. Of the reflected light, the polarized light component with the same polarization direction as that of the illumination light travels backward on the optical path of the illumination light to return to the illumination optical system 1.

On the other hand, of the reflected light, the polarized light component (modulated light) with the polarization direction orthogonal to that of the illumination light travels as follows.

P-polarized light of red color modulated by the red liquid crystal panel 2R is transmitted through the polarization beam splitting film of the first polarization beam splitter 33. Then, the P-polarized light of red color is converted into S-polarized light by being transmitted through a red cross color polarizer 35 which provides a half-wave retardation to polarized light of red color. The S-polarized light of red color enters a third polarization beam splitter 32, reflected by its polarization beam splitting film and then reach a projection lens (projection optical system) 4.

S-polarized light of blue color modulated by the blue liquid crystal panel 2B is reflected by the polarization beam splitting film of the first polarization beam splitter 33 and then transmitted through the red cross color polarizer 35 without receiving a retardation effect to enter the third polarization beam splitter 32. The S-polarized light of blue color is reflected by the polarization beam splitting film of the third polarization beam splitter 32 and then reaches the projection lens 4.

P-polarized light of green color modulated by the green liquid crystal panel 2G is transmitted through the polarization beam splitting film of the second polarization beam splitter 31 and then transmitted through a dummy glass 37 for correcting the optical path length of green color to enter the third polarization beam splitter 33. The P-polarized light of green color is transmitted through the polarization beam splitting film of the third polarization beam splitter 32 and then reaches the projection lens 4.

The modulated light of three colors thus combined is projected onto a light-diffusing screen 5 that is a projection surface by the projection lens 4. Thereby, a full-color image is displayed.

As described above, the minimum flicker inter-electrode potential differences of the liquid crystal panels for red, green and blue are different from each other. Therefore, the voltage setting and the voltage following control at the early stages of use may be performed independently for each liquid crystal panel.

Embodiment 4

In each of the above-described embodiments, the use of the apparatus was started in the state in which the potential to be applied to the ITO transparent electrode was intentionally lowered than the minimum flicker ITO electrode potential. In this method, since the lowered amount of the potential of the ITO transparent electrode exceeding 200 mV makes the flicker visible, the maximum lowered amount is 200 mV. However, the lowered amount of 200 mV may be insufficient to suppress the charge-up for some structures of films constituting the liquid crystal modulation element.

In this embodiment, description will be made of a control method for a liquid crystal modulation element having a film structure in which the charge-up suppressing effect obtained by lowering the potential to be applied to the ITO transparent electrode 102 is small.

Components identical to those in Embodiment 1 are designated with the same reference numerals as those in Embodiment 1. However, the structure of the alignment films in the liquid crystal modulation element is different from that in Embodiment 1.

First, description will be made of a method other than the method described in Embodiments 1 and 2 that suppresses change with time of the minimum flicker ITO electrode potential by lowering the potential to be applied to the ITO transparent electrode 102.

In a typical method disclosed Japanese Patent No. 3079402, a liquid crystal apparatus includes a photo detector and adjusts the potential of a common electrode by using the photo detector such that flicker is minimized.

This method using the light detector can also suppress occurrence of the flicker due to the change with time of the minimum flicker ITO electrode potential. However, the method has the following problems.

Firstly, the measurement of the flicker with the photo detector requires an output still image not changing with time, and the output still image should be a grey-level image suitable for the measurement of the flicker. Consequently, using the method disclosed in Japanese Patent No. 3079402 additionally requires an adjustment sequence for temporally outputting a certain gray-level image for adjustment (measurement), which disturbs a normal image display operation.

Furthermore, the adjustment sequence is normally performed at the time of power on or at the time of power off of the liquid crystal display apparatus, so that it is impossible to suppress a large variation of the minimum flicker ITO electrode potential during use.

Figure 11:
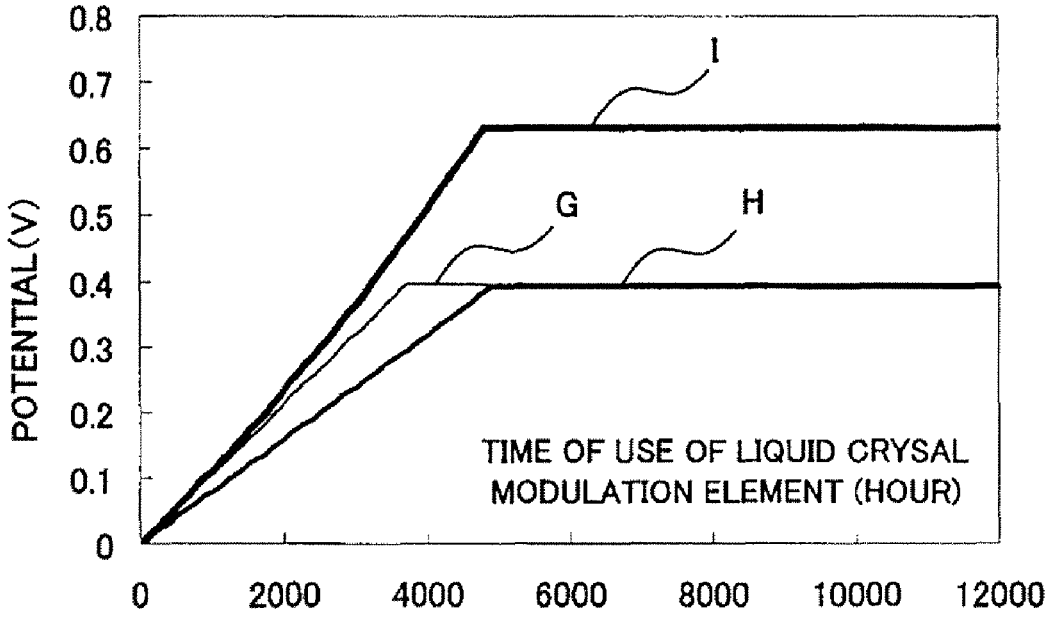
FIG. 11 is a graph for explaining the potential to be applied to the liquid crystal modulation element and the minimum flicker ITO electrode potential in Embodiment 4 of the present invention.

Next, this embodiment will be described with reference to FIG. 11. FIG. 11 shows the control of the DC voltage to be applied to the ITO transparent electrode 102, performed by the liquid crystal modulation element control circuit 204.

In FIG. 11, the graph G shows the change with time of the minimum flicker ITO electrode potential when the potential applied to the ITO transparent electrode 102 is equal to the potential applied to the metallic mirror electrode 103.

In this embodiment, the DC voltage (DC potential) to be applied to the ITO transparent electrode 102 from the DC voltage outputting circuit 201 is controlled as shown by the graph H in FIG. 11. The graph I shows change with time of the minimum flicker ITO electrode potential when the potential shown by the graph H is applied to the ITO transparent electrode 102.

At the early stages of use (0 hour), the potential to be applied to the ITO transparent electrode 102 is adjusted so as to coincide with the minimum flicker ITO electrode potential.

Then, the potential to be applied to the ITO transparent electrode 102 is automatically changed so as to follow the minimum flicker ITO electrode potential changing with lapse of time of use at a speed of approximately 0.08 mV per hour.

The changing speed of the potential to be applied to the ITO transparent electrode 102 is determined based on result values obtained from prior experiments or the like. The setting value of the potential to be applied to the ITO transparent electrode 102 can be determined within a range of ±200 mV from the curve of the typical minimum flicker ITO electrode potential obtained from experimental results.

Detailed setting values are determined based on a tendency of variations among individual liquid crystal modulation elements and the like. The setting data relating to the potential to be applied to the ITO transparent electrode 102 is stored in an inside memory included in the liquid crystal modulation element control circuit 204.

In this embodiment, the automatic changing control of the potential to be applied to the ITO transparent electrode 102 is ended at the time of saturation of the change with time of the minimum flicker ITO electrode potential (about 5,000 hours).

The control of the potential to be applied to the ITO transparent electrode 102 can extend the time at which the flicker begins to be seen by about 2,000 hours as compared with conventional apparatuses.

Furthermore, this embodiment makes it possible to perform a substantially real-time adjustment for minimizing the flicker during a normal display operation, without new additional components such as a photo detector and without being perceived by a user.

Embodiment 5

In Embodiment 4, the description was made of a substantially real-time adjustment of the potential to be applied to the ITO transparent electrode 102. In contrast, the adjustment may be performed at a predetermined time interval, that is, in a stepwise manner.

Figure 12:
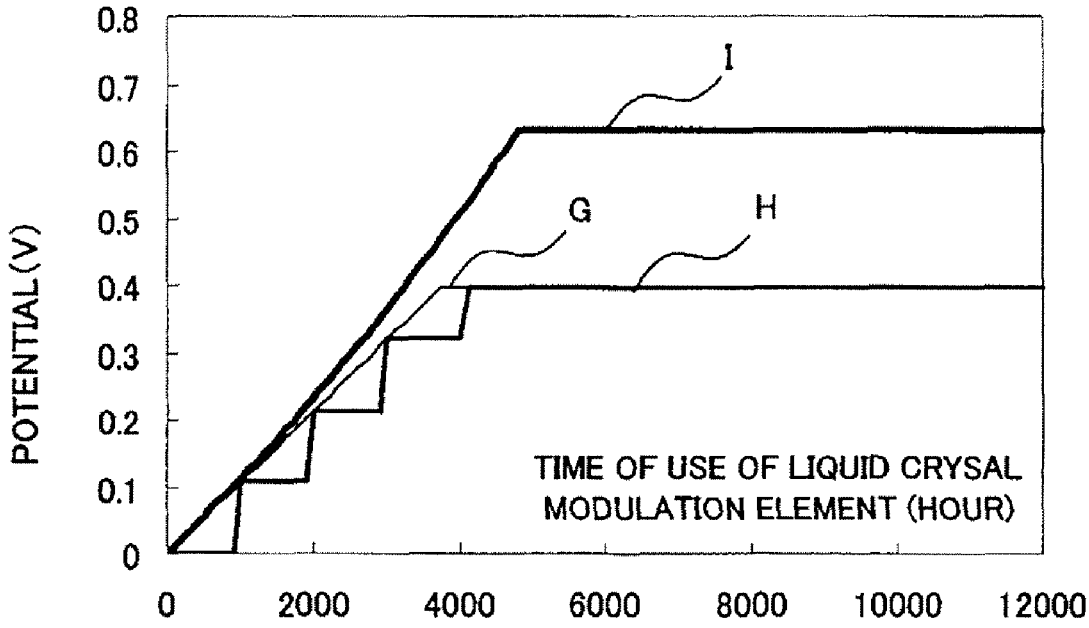
FIG. 12 is a graph for explaining the potential to be applied to the liquid crystal modulation element and the minimum flicker ITO electrode potential in Embodiment 5 of the present invention.

FIG. 12 shows the control of the DC voltage to be applied to the ITO transparent electrode 102, which is performed by the liquid crystal modulation element control circuit 204. The meanings of the graphs G, H and I in FIG. 12 are the same as those in Embodiment 4.

In this embodiment, the liquid crystal modulation element control circuit 204 causes the potential to be applied to the ITO transparent electrode 102 to shift based on a prediction of the change of the minimum flicker ITO electrode potential every lapse of a predetermined time period (for example, 1,000 hours) from the early stages of use.

It should be noted that, when the potential to be applied to the ITO transparent electrode is shifted every predetermined time period, the difference between the potential to be applied to the ITO transparent electrode after (immediately after) shifting and the minimum flicker ITO electrode potential is set to be smaller than the 200 mV (that is, within a range in which the flicker is invisible to human eyes). The difference is preferably smaller than 50 mV, more preferably smaller than 30 mV. The same is applied to Embodiment 6, described later.

In this embodiment, the potential to be applied to the ITO transparent electrode 102 after (immediately after) shifting is different from the minimum flicker ITO electrode potential in a direction opposite to the changing direction (the certain direction, herein the plus direction) of the minimum flicker ITO electrode potential. This makes it possible to delay the change of the minimum flicker ITO electrode potential.

However, it is allowed that the potential to be applied to the ITO transparent electrode 102 after (immediately after) shifting is different from the minimum flicker ITO electrode potential in the certain direction as in Embodiment 6 (FIGS. 13 and 14), described later. This allows a longer period to shift the potential to be applied to the ITO transparent electrode 102.

In addition, although the shift of the potential to be applied to the ITO transparent electrode 102, shown by the graph H, is ended after exceeding 4,000 hours in this embodiment, the present invention is not limited thereto. In other words, the shift of the potential to be applied to the ITO transparent electrode 102 may be continued after exceeding 4,000 hours so as to keep the flicker invisible to human eyes.

Thus, changing the potential to be applied to the ITO transparent electrode 102 in a direction of reducing the flicker makes it possible to suppress occurrence of the flicker. In addition, this embodiment can save the inside memory included in the liquid crystal modulation element control circuit 204.

Furthermore, although the potential to be applied to the ITO transparent electrode 102 is shifted in a 1,000 hour cycle in this embodiment, the shifting cycle may be, off course, a 100 hour cycle or a 10 hours cycle.

Embodiment 6

Figure 13:
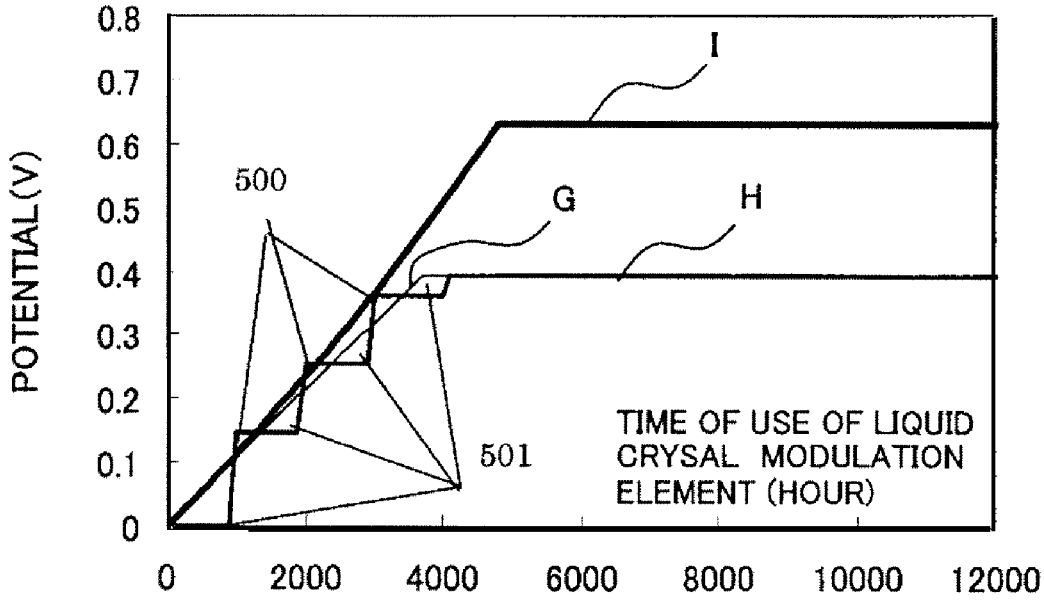
FIG. 13 is a graph for explaining the potential to be applied to the liquid crystal modulation element and the minimum flicker ITO electrode potential in Embodiment 6 of the present invention.

FIG. 13 shows Embodiment 6 as a modified example of Embodiment 5. In this embodiment, the liquid crystal modulation element control circuit 204 changes the potential to be applied to the ITO transparent electrode 102 in a stepwise manner to values a little larger than the predicted change values of the minimum flicker ITO electrode potential every lapse of a predetermined time period from the early stages of use. The larger values are determined with consideration of the subsequent change of the minimum flicker ITO electrode potential.

Thus, it is not necessarily required that the potential to be applied to the ITO transparent electrode 102 coincide with the minimum flicker ITO electrode potential even when changing the potential to be applied to the ITO transparent electrode 102 in a direction of reducing the flicker.

In this case, the shift amount of the potential to be applied to the ITO transparent electrode 102 is determined with reference to an amount that makes the difference between the changed potential 500 and the potential 501 immediately before the change positive to prevent an excessive acceleration of the change of the minimum flicker ITO electrode potential.

Figure 14:
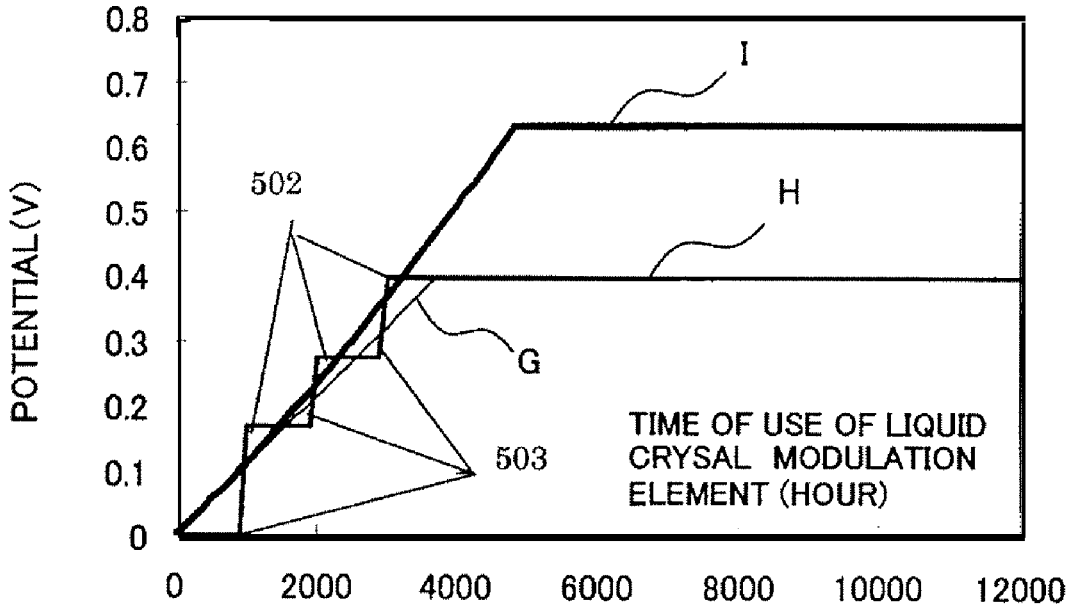
FIG. 14 is a graph for explaining the potential to be applied to the liquid crystal modulation element and the minimum flicker ITO electrode potential in a modified example of Embodiment 5.

Furthermore, in a case where an acceleration of the occurrence of the flicker caused by the change of the potential to be applied to the ITO transparent electrode 102 for following the minimum flicker ITO electrode potential hardly occurs due to the film structure of the liquid crystal modulation element, the control shown in FIG. 14 may be employed.

In this control, it is possible to set the potential to be applied to the ITO transparent electrode 102 based on the change of the minimum flicker ITO electrode potential, without the need to consider conditions such as the magnitude of each of the changed potential 502 and the potential 503 immediately before the change, shown in FIG. 14.

In this embodiment, the potential to be applied to the ITO transparent electrode 102 after (immediately after) shifting is different from the minimum flicker ITO electrode potential in the certain direction, and the difference between them is substantially 0 to 20 mv in FIG. 13 and 10 to 50 mv in FIG. 14.

The difference between the potential to be applied to the ITO transparent electrode 102 after (immediately after) shifting and the minimum flicker ITO electrode potential is preferably equal to or smaller than 100 mV, more preferably equal to or smaller than 50 mV, and further more preferably equal to or smaller than 30 mV.

The above-described difference may be large if the difference of the potential to be applied to the ITO transparent electrode 102 from the minimum flicker ITO electrode potential in the certain direction has a small influence on the acceleration of the change of the minimum flicker ITO electrode potential.

The control methods of the liquid crystal modulation element described in each of Embodiments 4 to 6 can be applied also to liquid crystal display apparatus such as the liquid crystal projector described in Embodiment 3.

As described above, in each of the embodiments, the potential to be applied to the ITO transparent electrode 102 is changed with increase of time of use such that the flicker as variations of light amount is suppressed within a range (certain range) in which it is not sensed by human eyes. In other words, the potential to be applied to the ITO transparent electrode 102 is changed with increase of time of use such that the difference between the absolute values of the positive and negative potential differences generated in the liquid crystal layer is suppressed within a difference range corresponding to the certain range (that is, a range in which the difference between the potential to be applied to the ITO transparent electrode 102 and the minimum flicker ITO electrode potential is smaller than 200 mV).

This makes it possible to effectively suppress the occurrence of the visible flicker, sticking or the like in a long-term use of the liquid crystal modulation element.

Consequently, it is possible to achieve a liquid crystal modulation element capable of reducing the deterioration of the quality of displayed images over a long period of time.

Furthermore, the control methods described in each of Embodiments 1, 2 and 4 to 6 can be applied also to a liquid crystal display apparatus other than the liquid crystal projector, such as a direct view type liquid crystal display apparatus.

In addition, the description was made of the case where the potential to be applied to the ITO transparent electrode was changed with increase of time of use. However, the central potential of the potential to be applied to the metallic mirror electrode may be changed with increase of time of use while the potential to be applied to the ITO transparent electrode is set to a constant value.

In this case the central potential of the mirror electrode to make the flicker minimum (minimum flicker mirror electrode potential) changes with increase of time of use in the minus direction with respect to the potential applied to the ITO transparent electrode 102 (0V). Therefore, the shift direction of the central potential of the potential to be applied to the mirror electrode with respect to the minimum flicker mirror electrode potential should be the plus direction.

Furthermore, both the potentials to be applied to the ITO transparent electrode and the mirror electrode may be changed with increase of time of use.

Moreover, the description was made of the case where the potential setting data was read out from the memory to change the potential to be applied to the electrode according to time of use. However, in embodiments of the present invention, a flicker sensor as a light amount sensor may be used to change the potential to be applied to the electrode based on the detection result of the sensor.

Furthermore, the present invention is not limited to these preferred embodiments and various variations and modifications may be made without departing from the scope of the present invention.

This application claims foreign priority benefits based on Japanese Patent Applications Nos. 2006-001898, filed on Jan. 6, 2006, and 2006-339570, filed on Dec. 18, 2006, and each of which is hereby incorporated by reference herein in its entirety as if fully set forth herein.

What is claimed is:

1. A liquid crystal display apparatus comprising:

a liquid crystal modulation element which includes a first electrode, a second electrode made of a material different from that of the first electrode, a liquid crystal layer disposed between the first and second electrodes, a first alignment film disposed between the first electrode and the liquid crystal layer, and a second alignment film disposed between the second electrode and the liquid crystal layer, the liquid crystal display apparatus displaying images with light entering the liquid crystal layer from the first electrode side; and a controller which controls potentials to be applied to the first and second electrodes such that the potential difference to be applied to the liquid crystal layer is periodically changed between positive and negative, the potential to be applied to the second electrode periodically changing between positive and negative with respect to a central potential, wherein the controller changes at least one of the potential to be applied to the first electrode and the central potential of the potential to be applied to the second electrode such that flicker is suppressed within a certain range, and wherein, when a first potential represents one of the potential to be applied to the first electrode and the central potential of the potential to be applied to the second electrode and a second potential represents the other thereof, the liquid crystal modulation element has a characteristic in which, in a case where the first and second potentials applied to the electrodes are equal to each other, the steady-state first potential which makes flicker minimum in every use of the liquid crystal modulation element is changed monotonically in a certain direction with respect to the second potential applied to one of the electrodes with increase of time of use of the liquid crystal modulation element, and the controller changes the first potential to be applied to the other of the electrodes relative to the second potential to be applied to the one in the certain direction.

2. The liquid crystal display apparatus according to claim 1, wherein the controller changes at least one of the potential to be applied to the first electrode and the central potential of the potential to be applied to the second electrode such that the difference of the absolute values of the positive and negative potential differences to be applied to the liquid crystal layer during displaying one frame image is suppressed within a difference range corresponding to the certain range.

3. The liquid crystal display apparatus according to claim 1, wherein the controller causes the first potential to be applied to the other of the electrodes to differ from the second potential to be applied to the one of the electrodes in a direction opposite to the certain direction at the early stages of time of use of the liquid crystal modulation element.

4. The liquid crystal display apparatus according to claim 1, wherein the controller changes at least one of the potential to be applied to the first electrode and the central potential of the potential to be applied to the second electrode in a direction of reducing the flicker.

5. The liquid crystal display apparatus according to claim 1, wherein the work functions of the materials of the first and second electrodes are different from each other.

6. The liquid crystal display apparatus according to claim 1, wherein the controller changes one of the potential to be applied to the first electrode and the central potential of the potential to be applied to the second electrode in a stepwise manner.

* * * * *